US006565322B1

(12) United States Patent
Lieser et al.

(10) Patent No.: US 6,565,322 B1
(45) Date of Patent: May 20, 2003

(54) TURBO-MACHINE COMPRISING A SEALING SYSTEM FOR A ROTOR

(75) Inventors: Dirk Lieser, Dortmund (DE); Arnd Reichert, Duisberg (DE); Micheal Strassberger, München (DE); Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/979,678

(22) PCT Filed: May 12, 2000

(86) PCT No.: PCT/EP00/04317

§ 371 (c)(1),
(2), (4) Date: Mar. 5, 2002

(87) PCT Pub. No.: WO00/70193

PCT Pub. Date: Nov. 23, 2000

(30) Foreign Application Priority Data

May 14, 1999 (EP) ..... 99109630

(51) Int. Cl.[7] ..... F01D 5/30
(52) U.S. Cl. ..... 416/219 R; 416/190; 416/193 A
(58) Field of Search ..... 416/219 A, 193 A, 416/220, 221, 248, 95, 190, 215

(56) References Cited

U.S. PATENT DOCUMENTS 4,818,182 A * 4/1989 Bouru ..... 416/215
4,878,811 A 11/1989 Jorgensen
5,143,517 A * 9/1992 Vermont ..... 416/190
5,478,207 A * 12/1995 Stec ..... 416/219 R
5,599,170 A 2/1997 Marchi et al.
6,042,336 A * 3/2000 Bulgrin et al. ..... 416/145
6,375,429 B1 * 4/2002 Halila et al. ..... 416/193 A
6,398,499 B1 * 6/2002 Simonetti et al. ..... 416/193 A
6,450,769 B2 * 9/2002 Szwedowicz ..... 416/190

FOREIGN PATENT DOCUMENTS

| | | |
|---|---|---|
| DE | 198 10 567 A1 | 3/1998 |
| EP | 0 761 930 A1 | 7/1996 |
| FR | 2 603 333 | 9/1986 |
| GB | 905582 | 5/1960 |

* cited by examiner

*Primary Examiner*—Edward K. Look
*Assistant Examiner*—James M McAleenan
(74) *Attorney, Agent, or Firm*—Harness Dickey & Pierce PLC

(57) ABSTRACT

The invention relates to a turbo-machine (1) comprising a rotor (25) that extends along a rotational axis (15). Said rotor (25) has a peripheral surface (31) which is defined by the outer radial delimitation surface of the rotor (25) and has a receiving structure (33) as well as a first moving blade (13A) and a second moving blade (13B). Each moving blade comprises a blade footing (43A, 43B) and a blade platform (17A, 17B). The blade platform (17A) of the first moving blade (13A) and the blade platform (17B) of the second moving blade (13B) border one another, and a gap (49) is formed between the blade platforms (17A, 17B) and the peripheral surface (31). A sealing system (51) is provided in the gap (49) on the peripheral surface (31).

27 Claims, 13 Drawing Sheets

TURBO-MACHINE COMPRISING A SEALING SYSTEM FOR A ROTOR

This application is the national phase under 35 U.S.C. §371 of PCT International Application No. PCT/EP00/04317 which has an International filing date of May 12, 2000, which designated the United States of America, the entire contents of which are hereby incorporated by reference.

FIELD OF THE INVENTION

The invention generally relates to a turbomachine including a sealing system for a rotor which extends along an axis of rotation, the rotor including a first rotor blade and a second rotor blade which adjoins the first rotor blade in the circumferential direction of the rotor.

BACKGROUND OF THE INVENTION

Rotatable rotor blades of turbomachines, for example of turbines or compressors, are secured in various designs over the entire circumference of the circumferential face of a rotor shaft which is formed, for example, by a rotor disk. A rotor blade usually has a main blade, a blade platform and a blade root with a securing structure which is fitted to the circumferential face of the rotor shaft in a suitably complementary recess, which is produced, for example, as a circumferential groove or an axial groove, so that the rotor blade is fixed in this way.

For design reasons, after the rotor blades have been inserted into the rotor shaft, gaps are formed by the regions which adjoin one another, and in operation of a turbine these gaps give rise to leaking flows of coolant or of a hot action fluid which drives the rotor. Such gaps occur, for example, between two adjacent blade platforms of rotor blades which adjoin one another in the circumferential direction and between the circumferential face of the rotor shaft and a blade platform which radially adjoins the circumferential face. To limit the possible leaking flows, such as for example the escape of coolant, e.g. of cooling air, into the flow channel of a gas turbine, intensive searches are being made for suitable sealing concepts which are able to withstand the temperatures which occur and the mechanical load caused by the considerable centrifugal forces acting on the rotating system.

DE 198 10 567 A1 has disclosed a sealing plate for a rotor blade of a gas turbine. If cooling air which is fed to the rotor blade escapes into the flow channel, this leads, inter alia, to a reduction in the efficiency of the gas turbine. The sealing plate, which is inserted into a gap between the blade platforms of adjacent rotor blades, is intended to prevent the leaking flows caused by the escape of cooling air. The sealing is produced not only by the sealing plate but also by various sealing pins which are likewise fitted between the blade platforms of two adjacent rotor blades. A multiplicity of sealing elements are required in order to achieve the desired sealing action preventing cooling air from escaping from the adjacent blade platforms.

U.S. Pat. No. 5,599,170 has described a sealing concept for a rotor blade of a gas turbine. A substantially radially extending gap and a substantially axially extending gap are formed by two rotor blades which adjoin one another and are attached to the circumferential face of a rotor disk which can rotate about an axis. A sealing element seals the radial gap and, at the same time, the axial gap. For this purpose, the sealing element is inserted into a cavity which is formed by the blade platforms of the rotor blades. The sealing element has a first sealing face and a second sealing face which respectively adjoin the axial gap and the radial gap.

Moreover, the sealing element has a thrust face which extends obliquely with respect to the radial direction. The thrust face directly adjoins a reaction face which is formed as a partial area of a moveable reaction element arranged in the cavity. The sealing action is produced by the centrifugal forces acting on the moveable reaction element as a result of the rotation of the rotor disk. The reaction element transmits to the inclined thrust face a force, the radially directed component of which acts on the sealing element, so that the first sealing face seals the axial gap, while the axially oriented component of the force on the sealing element leads to the second sealing face sealing the radial gap. This sealing concept is unable to prevent cooling air from escaping into the flow passage of the gas turbine along the circumferential face of the rotor disk through gaps which are formed between the circumferential face of the rotor disk and a blade platform of a rotor blade which radially adjoins the circumferential face.

Similarly complex arrangements with one or more sealing elements, as are described in DE 198 10 567 A1 or U.S. Pat. No. 5,599,170, are also used in a turbomachine to prevent a flowing, hot action fluid, e.g. a hot gas or vapor, from entering gap regions and spaces in a rotor. Penetrating action fluid of this type could lead to considerable damage to the rotor blade. To reduce this risk, generally a plurality of sealing elements are inserted into the blade platform on that side of the blade platform of the rotor blade which faces the flow of action fluid.

GB 905,582 and EP 0 761 930 A1 each describe a turbomachine with a turbine rotor of disk design, in which rotor blades are attached to the rotor disks by means of an axial fir-tree groove connection. Axial fixing of the rotor blades is produced by securing plates which are arranged in a fixed position on the end sides of the rotor disks, it also being possible to achieve a certain sealing action with respect to the penetration of action fluid in the blade root/groove region.

SUMMARY OF THE INVENTION

The invention is based on an object of providing a sealing system for a flow machine. The flow machine preferably includes a rotor which extends along an axis of rotation and includes a first rotor blade and a second rotor blade which adjoins the first rotor blade in the circumferential direction of the rotor.

The sealing system is in particular intended to actively limit the possible leaking flows through gap regions and spaces of the rotor and to be able to withstand the thermal and mechanical loads which occur.

According to the invention, an object is achieved by a turbomachine, having a rotor which extends along an axis of rotation. The turbomachine preferably includes a circumferential face, which is defined by the outer radial boundary surface of the rotor, and a receiving structure, as well as a first rotor blade and a second rotor blade. Each blade preferably includes a blade root and a blade platform which adjoins the blade root, the blade root of the first rotor blade and the blade root of the second rotor blade being inserted into the receiving structure, so that the blade platform of the first rotor blade and the blade platform of the second rotor blade adjoin one another. Further, a space is preferably formed between the blade platforms and the circumferential face, in which turbomachine a sealing system is provided on the circumferential face in the space.

The invention is based on a consideration that when a turbomachine is operating, the rotor is exposed to a flowing hot action fluid. As a result of the expansion, the hot action fluid applies work to the rotor blades and sets them in rotation about the axis of rotation. Therefore, the rotor with the rotor blades is subject to very high thermal and mechanical loads, in particular on account of the centrifugal forces which occur as a result of the rotation. A coolant, e.g. cooling air, which is usually fed to the rotor through suitable coolant feeds, is used to cool the rotor and in particular the rotor blades. In this case, leaking flows of both coolant and hot action fluid—what are known as gap losses—may occur in the space. A space is in this case formed by the circumferential face, which in this case is defined by the outer radial boundary surface of the rotor and by the platforms, arranged radially outside the circumferential face, of two rotor blades which are arranged next to one another in the circumferential direction of the rotor.

These leaking flows have a very disadvantageous effect on the cooling efficiency and the mechanical installation strength (quiet running and creep rupture strength) of the rotor blades in the receiving structure of the circumferential face. In this context, leaking flows which are oriented along the axis of rotation (axial leaking flows), for example along the circumferential face, are of particular importance. Furthermore, leaking flows perpendicular to the axis of rotation (radial leaking flows), which are directed along a radial direction and therefore substantially perpendicular to the circumferential face, should also be borne in mind.

The invention demonstrates a new way of effectively sealing a rotor with a first rotor blade and with a second rotor blade which adjoins the first rotor blade in the circumferential direction of the rotor in a turbomachine with respect to possible leaking flows. The arrangement takes account of both axial and radial leaking flows. This is achieved by the fact that the sealing system is arranged in the space on the circumferential face of the rotor.

As a result of the configuration described, the sealing system seals the space which is formed between the blade platforms and the circumferential face. The space extends in the radial and axial and circumferential directions of the rotor. In this case, the axial extent of the gap is generally dominant, while its extent in the circumferential direction is greater than the radial dimension. The precise geometry of the space is determined by the specific configuration of the mutually adjacent blade platforms and of the circumferential face. The design of the sealing system described can be individually adapted to the particular geometry and requirements with regard to the leaking flows which are to be restricted.

A significant advantage over conventional sealing concepts results from the sealing system being arranged on the circumferential face. As a result, it is possible for the sealing system to directly adjoin the circumferential face, so that a sealing action is produced. This is particularly suitable for preventing leaking flows in the axial direction along the circumferential face. By way of example, even the penetration of a hot action fluid, e.g. the hot gas in a gas turbine, into the space is substantially prevented and an axially directed flow in the space along the circumferential face is considerably reduced. This protects the material of the rotor, in particular the material of the blade platforms, from the high temperatures and the possible oxidizing and corrosive influences of the hot action fluid. In the radial direction the sealing system may be dimensioned in such a way that it directly adjoins the adjacent blade platforms and a sealing action is achieved. In this way, axial leaking flow is virtually completely prevented.

Temperature gradients in the region of the rotor blade attachment area are avoided by preventing leaking flows of hot action fluid and/or of coolant in the space by means of the sealing system. As a result, any thermal stresses resulting from impeded thermal expansion of rotor components which adjoin one another in the event of temperature differences are reduced. The blade root of a rotor blade and the receiving structure of the rotor which receives the rotor blade and fixes it can therefore be produced with significantly lower tolerances. A lower tolerance has an advantageous effect on the mechanical installation stability of the rotor blade and the quiet running of the rotor. In particular, form fits which are provided for the purpose of securing the blade root in the receiving structure can be provided with a lower clearance, which also correspondingly reduces possible leaking flows through the form fit.

A further advantage is the ease of producing and installing the sealing system. Since the sealing system is provided on the circumferential face, it is not necessarily fixedly coupled to a rotor blade. Installation or repair work on a rotor blade, such as for example, exchanging a rotor blade, can therefore be carried out without great difficulty. The sealing system remains unaffected by this work and can therefore be used a number of times.

In a preferred configuration of the turbomachine, the rotor has a rotor disk, which includes the circumferential face and the receiving structure, the circumferential face including a first circumferential-face edge and a second circumferential-face edge, which lies opposite the first circumferential-face edge along the axis of rotation, the receiving structure including a first rotor-disk groove and a second rotor-disk groove, which is at a distance from the first rotor-disk groove in the circumferential direction of the rotor disk, and the blade root of the first rotor blade being inserted into the first rotor-disk groove and the blade root of the second rotor blade being inserted into the second rotor-disk groove.

Therefore, the securing of the rotatable rotor blade is such that, when the turbomachine is operating, it is able to absorb the blade stresses caused by flow and centrifugal forces and by blade vibrations with a high degree of reliability and to transmit the forces which arise to the rotor disk and ultimately to the entire rotor. The rotor blade can be secured, by way of example, by axial grooves, each rotor blade being clamped individually in a dedicated rotor-disk groove which extends substantially in the axial direction. For low loads, e.g. in the case of axial compressor rotor blades of compressors, simple ways of securing the rotor blade, for example using a dovetail or Laval root, are possible. For steam-turbine end stages with long rotor blades and correspondingly high blade centrifugal forces, as well as the so-called plug-in root, the axial fir-tree root is also suitable. The axial fir-tree securing is preferably also employed for rotor blades which are subject to high thermal stresses in gas turbines.

In the preferred configuration described above, the circumferential face has a first circumferential-face edge and a second circumferential-face edge as partial regions. Based on the direction of flow of a flowing hot action fluid, in particular of the hot gas in a gas turbine, in this case, by way of example, the first circumferential-face edge is arranged upstream and the second circumferential-face edge is arranged downstream. Depending on the particular design details and requirements with regard to the sealing action to be achieved, this geometric division allows a configuration and arrangement of the sealing system over various partial regions of the circumferential face.

The sealing system is preferably arranged on the first circumferential-face edge and/or on the second circumferential-face edge. Arranging the sealing system on the first, for example upstream, circumferential-face edge primarily limits the penetration of flowing hot action fluid into the space and therefore prevents damage to the rotor blade. Arranging the sealing system on the second, downstream circumferential-face edge serves predominantly to prevent the escape of coolant, for example cooling air which is under a certain pressure in the space, in the axial direction along the circumferential face over the second circumferential-face edge into the flow passage. Since the hot action fluid expands in the direction of flow, the pressure of the hot action fluid is continuously reduced in the direction of flow. A coolant which is under a certain pressure in the space will therefore escape from the space in the direction of the lower ambient pressure, i.e. at the downstream circumferential-face edge. Arranging the sealing system on the first circumferential-face edge and on the second circumferential-face edge closes off the space and accordingly offers highly reliable protection both against the penetration of hot action fluid into the space and the escape of coolant from the space.

Preferably, a circumferential-face central region, which is bordered in the axial direction by the first circumferential-face edge and the second circumferential-face edge, is formed on the circumferential face, the sealing system being arranged at least partially on the circumferential-face central region. The circumferential-face central region forms a partial region of the circumferential face. Therefore, there are various options for arranging the sealing system on various partial regions of the circumferential face together with the first and second circumferential-face edges. Depending on design details and requirements with regard to the sealing action to be achieved, it is possible to determine a suitable solution, with the sealing system arranged on various partial regions. Combinations of various partial regions are also conceivable when arranging the sealing system. Therefore, with regard to adapting to specific requirements in terms of the sealing action to be achieved, the sealing system described offers a very high degree of flexibility.

The sealing system preferably has a sealing element which extends in the circumferential direction. The space extends substantially in the radial and axial directions and in the circumferential direction of the rotor. A sealing element which extends along the circumferential direction of the rotor in the space is particularly suitable for preventing the possibility of axial leaking flows of coolant and/or also of hot action fluid with a high degree of efficiency. For example, an axial leaking flow in the upstream direction, for example a hot gas leaking out of the flow passage of a gas turbine, which spreads out along the circumferential face is effectively prevented by the sealing element. In this case, the leaking flow is delayed by the obstacle in the space and ultimately comes to a standstill on that side of the sealing element which faces the leaking flow (simple restrictor). That side of the sealing element which is remote from the leaking flow and that part of the space which adjoins it in the axial direction are already effectively protected from being exposed to the leaking medium, e.g. hot action fluid or coolant, by the simple sealing element.

A considerable improvement to the simple solution described above with a sealing element extending in the circumferential direction results from combining the sealing element with one or more further sealing elements. In a preferred configuration, at least one further sealing element is provided, which extends in the circumferential direction and is arranged at an axial distance from the sealing element. This multiple arrangement of sealing elements considerably reduces possible leaking flows in the space. In particular, it is possible, for example, for the sealing element to be arranged on the first circumferential-face edge and for the further sealing element to be arranged on the second circumferential-face edge.

As a result, the space is sealed both upstream and downstream with respect to axial leaking flows. The space is in particular protected very effectively against the possibility of the penetration of hot action fluid both from the upstream region at higher pressure and from the downstream region at lower pressure in the flow passage. At the same time, the sealed space can be used effectively by a coolant, e.g. cooling air. The coolant is fed to the space under pressure and is used primarily for efficient internal cooling of the highly thermally stressed rotor, the blade platform and the main blade which radially adjoins the blade platform.

A further advantageous use for the pressurized coolant in the space includes utilizing its barrier action with respect to the hot action fluid in the flow passage. The design of the sealing elements and the selection of the pressure of the coolant in the space mean that the pressure difference between the coolant and the hot action fluid is adequately low yet sufficiently high to achieve a barrier action with respect to the hot action fluid. For this purpose, the pressure of the coolant which prevails in the space must be only slightly above the upstream pressure of the hot action fluid. The greater the sealing action of the sealing elements, the smaller any residual leaking flows of coolant into the flow passage become.

The sealing element preferably engages in a recess, in particular in a groove, in the circumferential face. The sealing element is prevented from falling out and/or from being thrown out under the action of centrifugal forces in steady-state operation or in the event of a transient load on the turbomachine is achieved by the fact that the sealing element engages in a suitable recess. Furthermore, the recess produces a sealing surface, which is expediently designed as a partial area of the recess, on the circumferential face. In the case of a groove, this sealing surface is formed, for example, at the base of the groove. To achieve the optimum sealing action when the sealing element is active, the sealing surface is produced with a suitably low and well-defined surface roughness. After the actual production of the groove, for example by abrading material from the circumferential face by means of a milling or turning operation, a sealing surface with the desired roughness can be produced on the base of the groove by polishing.

The sealing element is preferably moveable in the radial direction. This has the effect of causing the sealing element to move away from the axis of rotation of the rotor in the radial direction under the action of centrifugal force. This property is deliberately exploited in order to achieve a significantly improved sealing action at the blade platform of a rotor blade. Under the action of centrifugal force, the sealing element comes into contact with the blade platforms which are at a radial distance from the circumferential face and adjoin one another in the circumferential direction and is pressed firmly onto the blade platforms. The radial mobility of the sealing element can be ensured by suitable dimensioning of the recess and of the sealing element. Furthermore, it is advantageous that, as a result, the sealing element can be removed and, if appropriate, exchanged without problems for any maintenance to be carried out or in the event of failure of the rotor blade without using additional tools and without the risk of the sealing element becoming stuck as a result of oxidizing or corrosive attack under high operating temperatures. Furthermore, a certain tolerance of the sealing element which engages in the recess, in particular in the groove, is very useful, since as a result thermal expansion is permitted, and therefore thermally induced stresses are avoided in the rotor.

The sealing element preferably includes a first partial sealing element and a second partial sealing element, the first partial sealing element and the second partial sealing element engaging in one another. The partial sealing elements may be designed in such a way that they provide, in a particular manner, a partial sealing function for different regions in the space which are to be sealed. These different regions in the space are formed, for example, by suitable sealing surfaces at the base of the groove, on the blade platform of the first rotor blade or on the blade platform of the second rotor blade. As a result of being arranged as a pair of partial sealing elements, the partial sealing elements combine to form one sealing element, the sealing action of the pair being greater than that of a single partial sealing element. By suitably adapting the design of the partial sealing elements to the partial regions in the space which are to be sealed, it is possible for the sealing action of the paired partial sealing elements to be greater than that which can be achieved, for example, with a single-piece sealing element.

Preferably, the first partial sealing element and the second partial sealing element can move in the circumferential direction relative to one another. This provides a matched system comprising partial sealing elements. The relative movement of the partial sealing elements in the circumferential direction allows matched engagement of the partial sealing elements in one another as a function of the thermal and/or mechanical loads acting on the rotor. The matched system of partial sealing elements may be designed in such a way that under the action of the external forces, such as for example the centrifugal force and the normal and bearing forces, it to a certain extent adjusts itself in order to provide its sealing action. Furthermore, possible thermally or mechanically induced stresses are compensated for significantly more successfully by the movable pair of partial sealing elements.

In a preferred configuration, the first partial sealing element and the second partial sealing element each have a disk-sealing edge, which adjoins the circumferential face, and a platform-sealing edge, which adjoins the blade platform. In this case, the platform-sealing edge may in each case be further functionally divided into partial platform-sealing edges. By way of example, for a partial sealing element there may be a first partial platform-sealing edge and a second partial platform-sealing edge, the first partial platform-sealing edge being adjacent to the blade platform of the first rotor blade and the second partial platform-sealing edge being adjacent to the blade platform of the second rotor blade. This functional division makes it easy to adapt the.design of the partial sealing elements to the particular installation geometry of the first and second rotor blades in the receiving structure. Suitable designing of the partial sealing element ensures that the disk-sealing edge is sealed against the circumferential face and the platform-sealing edge is sealed against the blade platform of the rotor blade, producing the best possible form fit.

The paired arrangement of the first and second partial sealing elements to form a sealing element provides a particularly effective seal. The first and second partial sealing elements preferably overlap one another, with the platform-sealing edge and the disk-sealing edge of the first partial sealing element being adjacent to the platform-sealing edge and disk-sealing edge, respectively, of the second partial sealing element. As a result, the paired arrangement of the two partial sealing elements produces a good positive lock, and consequently the sealing element produces a good seal against the penetration of hot action fluid into the space and/or the escape of coolant into the flow passage.

The sealing element is preferably made from a material which is able to withstand high temperatures, in particular from a nickel-base or cobalt-base alloy. These alloys also have sufficient elastic deformation properties. The result is that the material of the sealing element, in order to avoid contamination or diffusion damage and to ensure a uniform thermal expansion of the rotor, in particular of the blade platform of the rotor blade, is selected to match the material of the rotor.

In a preferred configuration, the sealing system has a labyrinth sealing system, in particular a labyrinth gap sealing system. The action of a labyrinth sealing system is based on the most effective possible restriction of the hot action fluid and/or of the coolant in the sealing system and a resulting substantial prevention of an axially directed leaking flow (leak mass flow) through the space. In this case, a residual leaking flow through existing sealing gaps, as generally occur with labyrinth gap seals, can be calculated taking account of the so-called bridging factor. With the same flow parameters upstream and downstream of the seal and identical principal dimensions of the labyrinth sealing system (sealing gap diameter, sealing gap width, overall axial length of the seal), labyrinth gap sealing systems, which are also referred to as look-through seals, compared to so-called tongue-and-groove sealing systems have a leaking flow through the sealing gap which is up to 3.5 times greater. However, on account of the sealing gap which remains, labyrinth gap sealing systems have the considerable advantage over the tongue-and-groove sealing systems that they themselves are suitable for considerable thermally and/or mechanically induced relative expansions in the rotor.

The sealing system is preferably produced integrally, in particular by removing material from the rotor disk. If the sealing system is designed, for example, as a labyrinth sealing system, it is produced by means of at least two sealing elements on the circumferential surface, which extend in the circumferential direction of the rotor disk and are at an axial distance from one another. These sealing elements may be formed by metal restrictor plates which are turned out of the solid. The integral production method has the advantage that there is no need for an additional joining element between the labyrinth sealing system and the circumferential face. Therefore, in terms of process engineering, the rotor disk can be machined and the labyrinth sealing system produced in a single step carried out on a lathe, which is very inexpensive. Furthermore, thermally induced stresses between the rotor disk and the labyrinth sealing system do not play any role, since only one material is used. Alternative configurations of the sealing element, for example by using a metal restrictor plate welded onto the rotor disk or by using a metal restrictor plate which is jammed into a groove into the circumferential face, are also possible.

On its outer radial end, the sealing element preferably has a sealing point, in particular a knife edge.

Residual leaking flows through the space are decisively influenced by the sealing gap width which can be achieved, i.e. for example the distance between the outer radial end of the sealing element and the adjoining blade platform which is to be sealed. To make the sealing gap width as small as possible, it is provided for the outer radial end of the sealing element to be sharpened. In this case, it is possible, in particular to bridge the sealing gap, by producing the sealing point or the knife edge with a small dimension compared to the radial installation dimension of the blade platform. By drawing the sealing tip or the knife edge onto the blade platform, the sealing gap is bridged when the rotor blade is inserted into the receiving structure, for example into an axial groove in a rotor disk. In this way, the sealing gap is closed off, an improved seal is achieved and the axial leaking flow is further reduced. Compared to conventional designs, therefore, it is also possible to considerably reduce the installation dimension of a rotor blade in the receiving structure. The minimum installation dimension which has hitherto been customary of between approximately 0.3 and approximately 0.6 mm can be reduced to approximately 0.1 to approximately 0.2 mm by using the new design, i.e. is reduced by approximately two thirds.

In a preferred configuration, a gap sealing element is provided for sealing a substantially axially extending gap, the gap being formed between the blade platform of the first rotor blade and the blade platform of the second rotor blade and being in flow communication with the space. The gap sealing element prevents a leaking flow through the gap. A leaking flow of this type is substantially radially directed and may be oriented both radially outward from the space through the gap and radially inward through the gap into the space.

In this case, various designs are possible:

For example, if the flow passage of the turbomachine, e.g. of a compressor or a gas turbine, adjoins the gap in the radially outward direction, the gap sealing element prevents the penetration of the action fluid, e.g. of the hot gas in a gas turbine, radially inward into the space through the gap. As a result, the rotor, in particular the rotor blade, is protected from oxidizing and/or corrosive attack in the space. At the same time the gap sealing element prevents coolant, e.g. cooling air, from escaping from the space through the gap radially outward into the flow passage.

In an alternative configuration, a cavity may also adjoin the gap on the radially outer side, this cavity being formed by the first and second rotor blades which adjoin one another in the circumferential direction (known as the box design of a rotor blade). In this case, the gap sealing element firstly prevents the possibility of hot action fluid penetrating from the space through the gap radially outward into the cavity. Secondly, the cavity which is sealed by the gap sealing element can be acted on by a coolant, e.g. cooling air. This coolant is under pressure in the cavity and is available, for example, for efficient internal cooling of the rotor blade which is subject to high thermal loads or for other cooling purposes. A further advantageous use of the pressurized coolant in the cavity consists in utilizing its barrier action with respect to the hot action fluid in the flow passage.

The gap sealing element is preferably produced by a metal gap sealing plate which has a gap-sealing edge which engages in the gap under the action of centrifugal force and closes off the gap. Designing the gap sealing element as a metal gap sealing plate represents a simple and inexpensive solution. In this case, for example, a design as a thin metal strip which has a longitudinal axis and a transverse axis is possible. In this case, the gap-sealing edge extends substantially centrally on the metal strip along the longitudinal axis and can be produced in a simple way by bending over the metal strip. The gap sealing element is expediently arranged in the space. When the turbomachine is operating, the gap sealing element is then, as a result of the rotation, pressed firmly by the radially outwardly directed centrifugal force against the mutually adjoining blade platform, the gap-sealing edge engaging in the gap and effectively sealing the latter.

The gap sealing element is preferably made from a material which is able to withstand high temperatures, in particular from a nickel-base or cobalt-base alloy. Moreover, these alloys also have sufficient elastic deformation properties. The material of the gap sealing element is selected to match the material of the rotor, with the result that contamination or diffusion damage is avoided. Furthermore, uniform thermal expansion or contraction of the rotor, in particular of the blade platform of the rotor blade, is ensured.

The gap sealing element preferably radially adjoins the sealing system. The combination of the gap sealing element with a sealing system arranged on the circumferential face, in particular with a labyrinth sealing system, results in particularly effective sealing of the space against the possibility of leaking flows of hot action fluid and/or of coolant. In particular, as a result a centrifugally assisted sealing action of the gap sealing element is retained in order to seal an axially extending gap. In this combination, the sealing system reduces the substantially axially oriented leaking flows, while the gap sealing element reduces the substantially radially directed leaking flows. Furthermore, this separation of functions readily allows flexible design adjustment to different rotor geometries. Consequently, the gap sealing element and the sealing system complement one another very effectively.

In a preferred configuration, in the turbomachine with the rotor extending along an axis of rotation, the receiving structure is produced by a circumferential groove, the circumferential face having a first circumferential face and a second circumferential face which lies opposite the first circumferential face along the axis of rotation, these faces in each case axially adjoining the circumferential groove, the sealing system being provided in the space on the first and/or second circumferential face.

When the turbomachine is operating, the means of securing the rotor blades must with great reliability absorb the blade stresses caused by flow and centrifugal forces and by the vibrations of the blade and must transmit the forces which are generated to the rotor disk and ultimately to the entire rotor. In addition to securing the rotor blade in an axial groove, an arrangement in which the rotor blade is secured in a circumferential groove is also in widespread use, particularly for low and medium stresses. In this case, various configurations are known depending on the stress (c.f. I. Kosmorowski and G. Schramm, "Turbo Maschinen" [Turbomachines], ISBN 3-7785-1642-6, published by Dr. Alfred Hüthig Verlag, Heidelberg, 1989, pp. 113–117).

By way of example, for short rotor blades with low centrifugal forces and bending moments, the so-called hammerhead connection method, which is easy to produce, is used. In the case of longer rotor blades and therefore higher blade centrifugal forces, in the case of rotors of disk design, particular design measures have to be used to prevent the rotor disk from bending in the region of the first and second circumferential faces at the level of the circumferential groove. This can be achieved, for example, with the aid of a rotor disk which is of solid design at the level of the circumferential groove, a hooked hammerhead root or a hooked sliding root. However, a more efficient transmission of forces to the rotor disk is achieved, for example, by the circumferential fir-tree securing device. In any event, the described concept for sealing the space can be transferred very flexibly to a rotor in which the rotor blade is secured in a circumferential groove.

The turbomachine is preferably a gas turbine.

BRIEF DESCRIPTION OF THE DRAWINGS

The invention is explained in more detail below, by way of example, with reference to exemplary embodiments illustrated in the drawing, in which, in some cases diagrammatically and in simplified form.

In the individual figures, identical reference numerals have the same meaning.

DETAILED DESCRIPTION OF THE PREFERRED EMBODIMENTS

Figure 1:
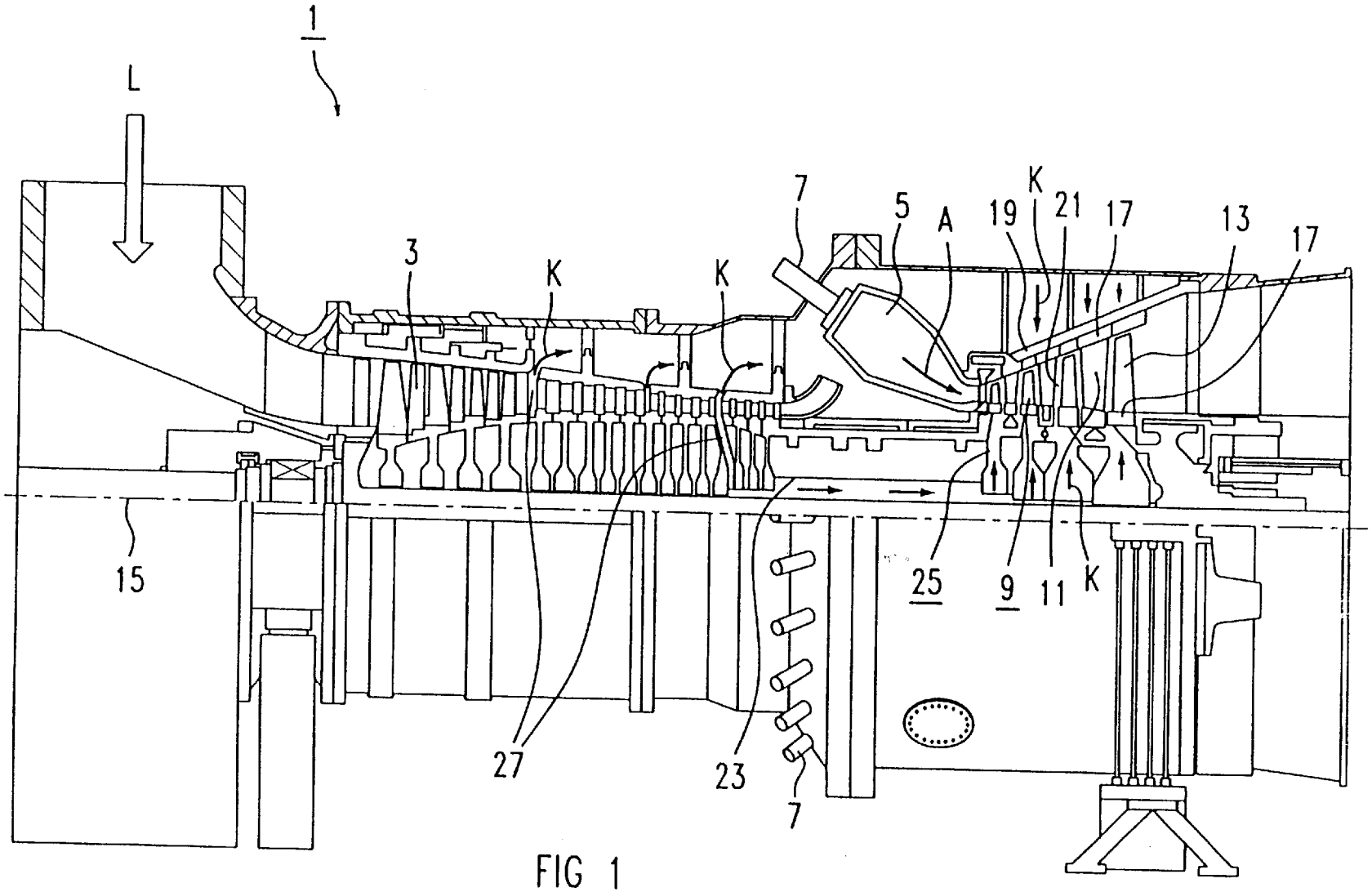
FIG. 1 shows a half-section through a gas turbine with compressor, combustion chamber and turbine.

FIG. 1 shows a half-section through a gas turbine 1. The gas turbine 1 includes a compressor 3 for combustion air, a combustion chamber 5 with burners 7 for a liquid or gaseous fuel, and a turbine 9 for driving the compressor 3 and a generator, which is not shown in FIG. 1. Fixed guide blades 11 and rotatable rotor blades 13 are arranged in the turbine 9 on respective rings, which extend radially and are not shown in the half-section, along the axis of rotation 15 of the gas turbine 1. A pair of a ring of guide blades 11 (guide-blade ring) and a ring of rotor blades 13 (rotor-blade ring) which follow one another along the axis of rotation 15 are referred to as a turbine stage. Each guide blade 11 has a blade platform 17 which is arranged on the inner turbine casing 19 in order to fix the corresponding guide blade 11. The blade platform 17 represents a wall element in the turbine 9. The blade platform 17 is a component which is subject to high thermal loads and forms the outer boundary of the flow passage 21 in the turbine 9. The rotor blade 13 is attached to the turbine rotor 23, which is arranged along the axis of rotation 15 of the gas turbine 1, by means of a corresponding blade platform 17.

The turbine rotor 23 may be assembled, for example, from a plurality of rotor disks which are not shown in FIG. 1, receive the rotor blades 13, are held together by a tie rod (not shown) and are centered, in such a manner that they are able to tolerate thermal expansion, on the axis of rotation 15 by use of radial serrations. Together with the rotor blades 13, the turbine rotor 23 forms the rotor 25 of the turbomachine 1, in particular of the gas turbine 1. In the region of the gas turbine 1, air L is sucked in from the environment. The air L is compressed in the compressor 3 and as a result is simultaneously preheated. In the combustion chamber 5, the air L is brought together with the liquid or gaseous fuel and is burned. A fraction of the air L which has been removed from the compressor 3 at suitable removal device 27 is used as cooling air K to cool the turbine stages, the first turbine stage being exposed, for example, to a turbine inlet temperature of approximately 750° C. to 1200° C. Expansion and cooling of the hot action fluid A, referred to below as hot gas A, which flows through the turbine stages and in the process sets the rotor 25 in rotation, take place in the turbine 9.

Figure 2:
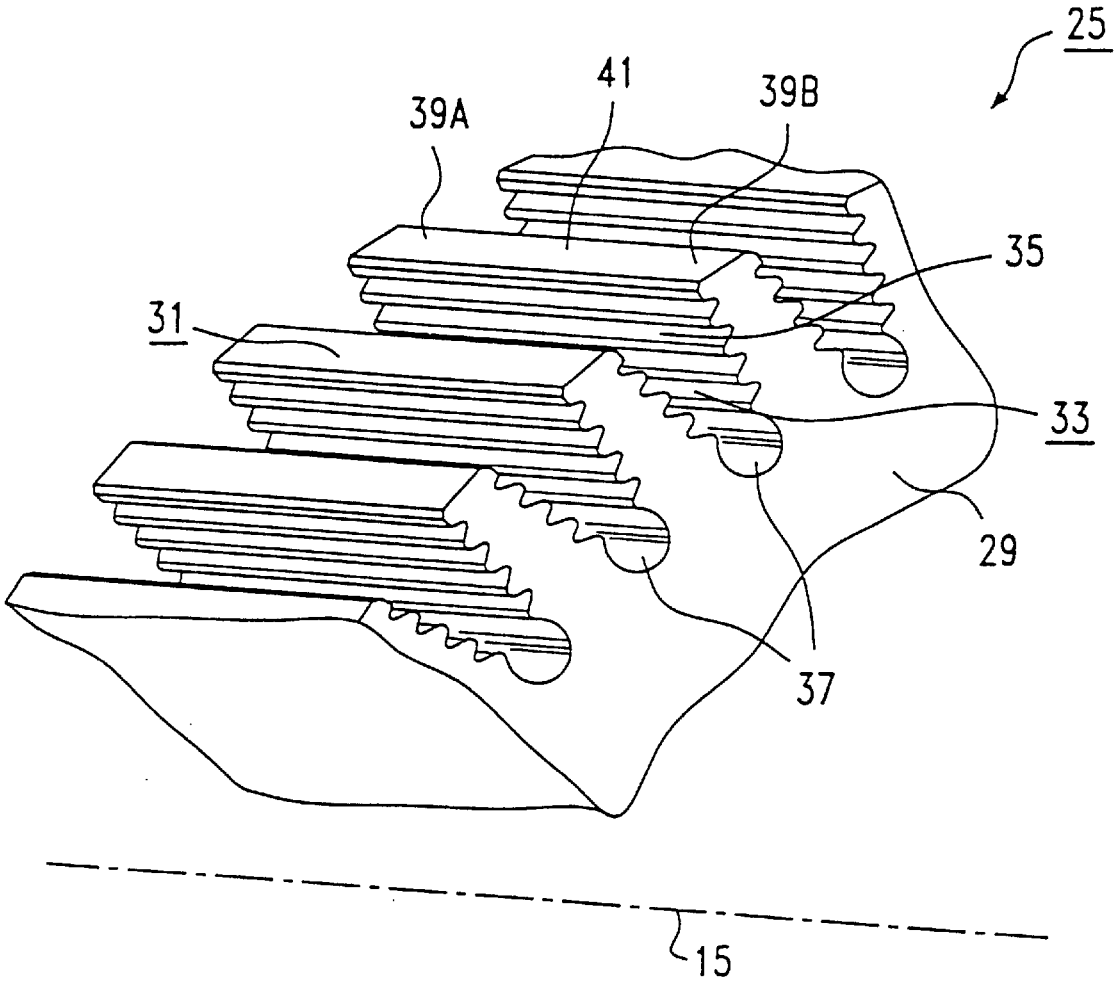
FIG. 2 shows a perspective view of part of a rotor disk of a rotor.

FIG. 2 shows a perspective view of part of a rotor disk 29 of a rotor 25. The rotor disk 29 is centered along the axis of rotation 15 of the rotor 25.

The rotor disk 29 includes a receiving structure 33 for rotor blades 13 of the gas turbine 1 to be secured in. The receiving structure 33 is produced by recesses 35, in particular by grooves, in the rotor disk 29. The recess 35 is in this case designed as an axial rotor-disk groove 37, in particular as an axial fir-tree groove. The rotor disk 29 has a circumferential face 31 which is arranged at.the outer radial end of the rotor disk 29. The circumferential face 31 is defined by the outer radial boundary surface of the rotor 25 or of the rotor disk 29. The circumferential face 31 defined in this way does not include the receiving structure 33 which is designed as an axial rotor-disk groove 37. A first circumferential-face edge 39A and a second circumferential-face edge 39B are formed on the circumferential face 31. The first circumferential-face edge 39A lies opposite the second circumferential-face edge 39B on the circumferential face 31 along the axis of rotation 15. A circumferential-face central region 41, which in the axial direction is bordered by the first circumferential-face edge 39A and the second circumferential-face edge 39B, is formed on the circumferential face 31.

Figure 3:
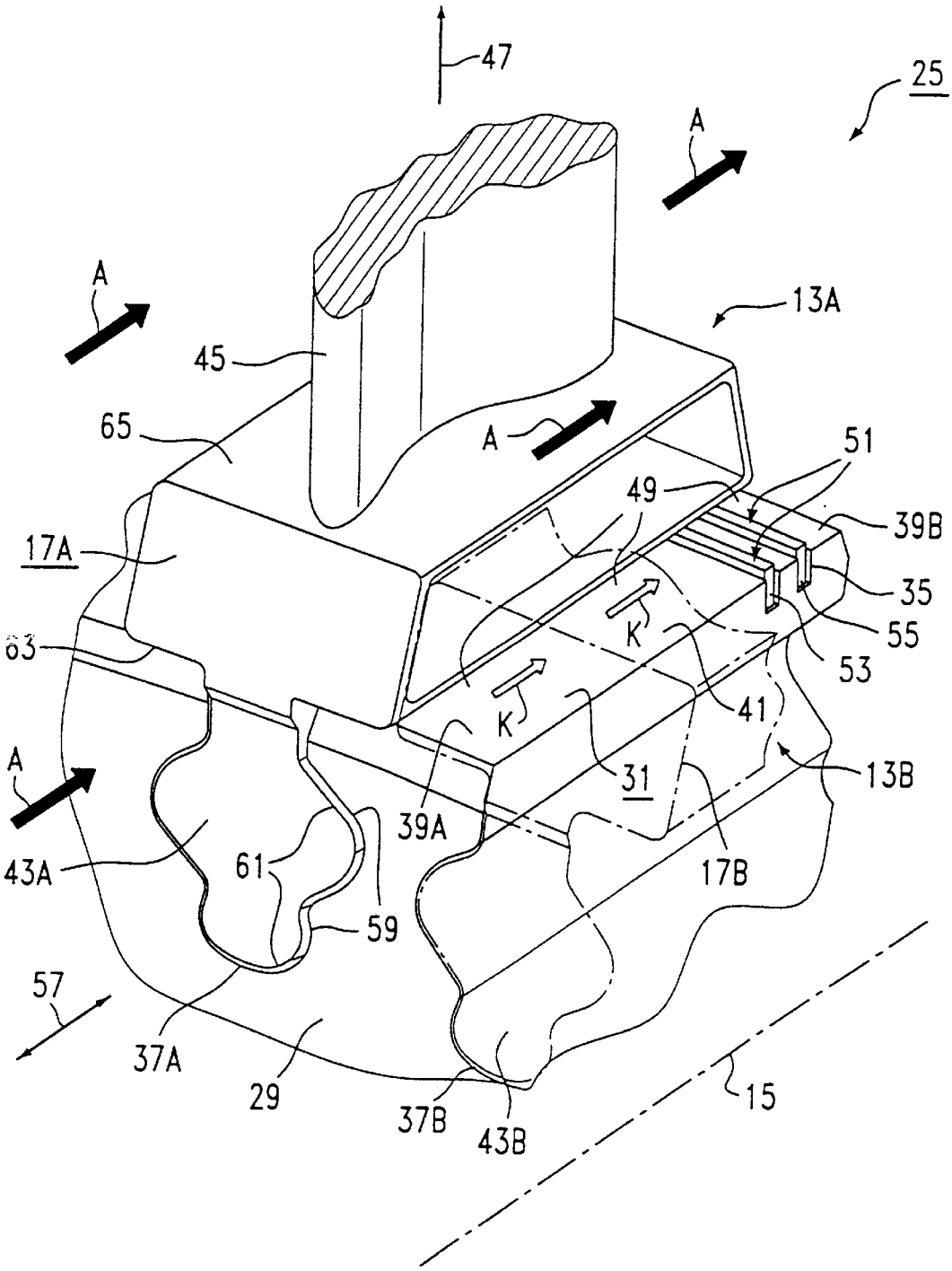
FIG. 3 shows a perspective view of part of a rotor disk with inserted rotor blade.

A perspective view of part of a rotor disk 29 with inserted rotor blade 13A is illustrated in FIG. 3. The rotor disk 29 has rotor-disk grooves 37A, 37B, which are open toward its circumferential face 31, over its entire circumference; these grooves run substantially parallel to the axis of rotation 15 of the rotor 25, although they may also be inclined with respect to this axis. The rotor-disk grooves 37A, 37B are provided with undercuts 59. The blade root 43A of a rotor blade 13A is inserted into a rotor-disk groove 37A along the insertion direction 57 of the rotor-disk groove 37A. The blade root 43A is supported, by using longitudinal ribs 61, against the undercuts 59 of the rotor-disk groove 37A. In this way, when the rotor disk 29 rotates about the axis of rotation 15, the rotor blade 13A is held securely with regard to the centrifugal forces which occur in the direction of the longitudinal axis 47 of the rotor blade 13A. In the radially outward direction, along the longitudinal axis 47 of the blade root 43A, the rotor blade 13A has a widened region, known as the blade platform 17A. The blade platform 17A has a disk-side base 63 and an outer side 65 which is on the opposite side from the disk-side base 63. On the outer side 65 of the blade platform 17A there is a main blade 45 of the rotor blade 13A. The hot gas A which is required for operation of the rotor 25 flows past the main blade 45 and, in the process, generates a torque on the rotor disk 29. At high operating temperatures of the rotor 25, the main blade 45 of the rotor blade 13A requires an internal cooling system, which is not shown in FIG. 3. In this case, a coolant K, for example cooling air K, is passed through a feed line (not shown) through the rotor disk 29 into the blade root 43A of the rotor blade 13A and, from there, to suitable supply lines (likewise not shown in FIG. 3) of the internal cooling system.

To prevent the coolant K, in particular the cooling air K, from escaping prematurely in the region of the blade root 43A and of the blade platform 17, a sealing system 51 is provided. The sealing system 51 is arranged on the circumferential face 31 on the second circumferential-face edge 39B. The sealing system 51 includes a sealing element 53 which extends in the circumferential direction of the rotor disk 29. A further sealing element 55 is preferably provided and extends in the circumferential direction of the rotor disk 29, at an axial distance from the sealing element 53.

The sealing element 53 and the further sealing element 55 each engage in a recess 35, in particular in a groove, in the circumferential face 31. The sealing system 51 seals the space 49 which is formed between the blade platform 17A of the rotor blade 13A and a blade platform 17B of a second rotor blade 13B, which is illustrated by dashed lines and is inserted into a second rotor-disk groove 37B, which is at a distance from the first rotor-disk groove 37A in the circumferential direction of the rotor disk 29, and the circumferential face 31. This substantially prevents the hot gas A from passing axially over the second circumferential-face edge 39B into the space 49 and damaging the rotor blade 13A, 13B in the region of the blade root 43A, 43B or the blade platform 17A, 17B. Furthermore, coolant K is prevented from escaping from the space 49 in the axial direction along the circumferential face 31 over the second circumferential-face edge 39B.

Figure 4:
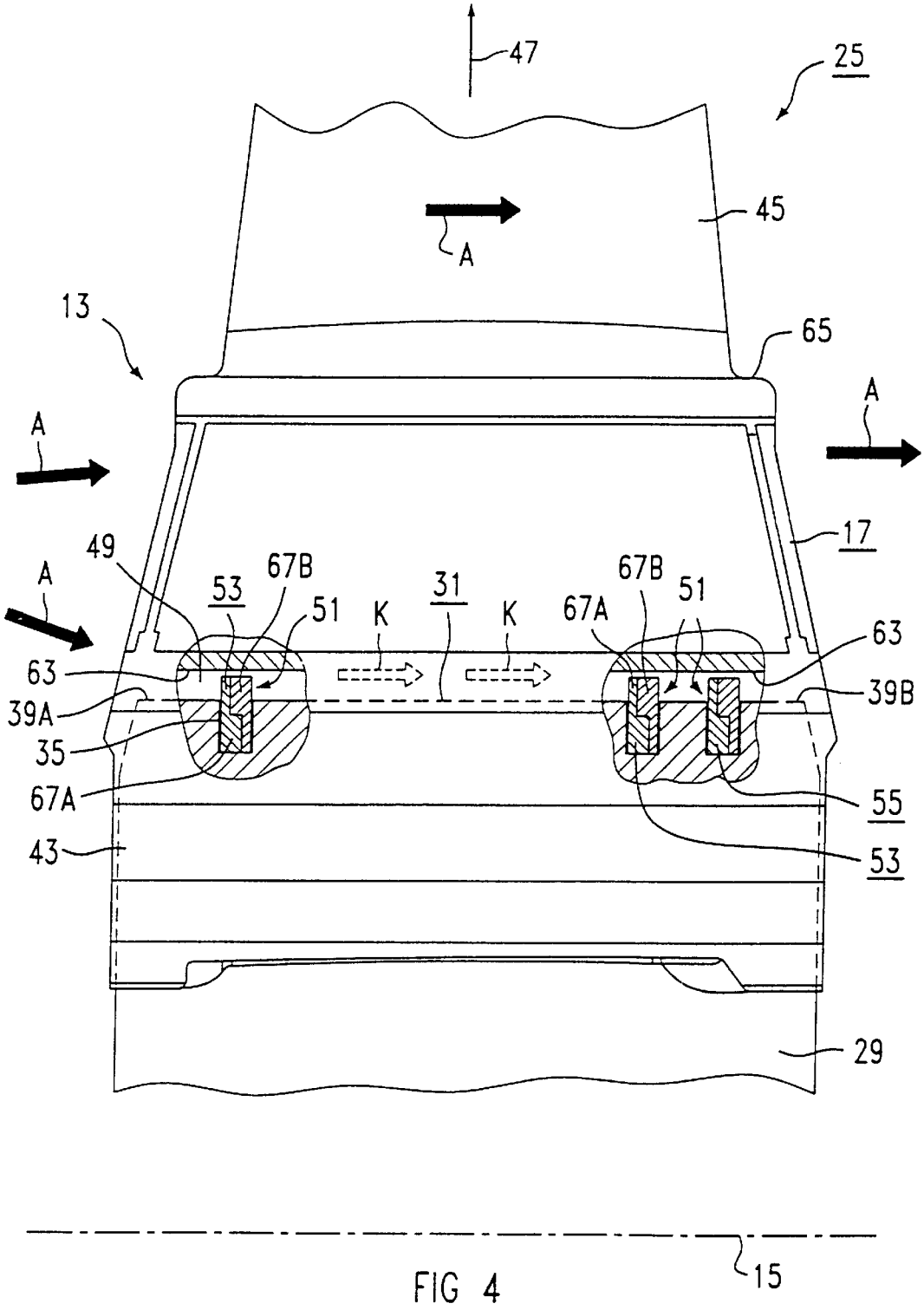
FIG. 4 shows a side view of a rotor blade with sealing system.

FIG. 4 shows a side view of a rotor blade 13 with sealing system 51. The sealing system 51 is illustrated as a partial section in FIG. 4. The sealing system 51 is arranged on the first circumferential-face edge 39A and on the second circumferential-face edge 39B in the space 49. Based on the direction of flow of the hot gas A, the first circumferential-face edge 39A is located upstream on the circumferential face 31 of the rotor disk 29, and the second circumferential-face edge 39B is located downstream.

The arrangement of the sealing system 51 on the first, upstream circumferential-face edge 39A firstly restricts the penetration of flowing hot gas A into the space 49. This prevents damage to the rotor blade 13 and to the rotor disk 29 in the region of the circumferential face 31. Arranging the sealing system 51 on the second, downstream circumferential-face edge 39B serves primarily to prevent as efficiently as possible the escape of a coolant K, e.g. cooling air K which is under a certain pressure in the space 49, in the axial direction along the circumferential face 31 over the second circumferential-face edge 39B into the flow passage.

When the rotor 25 is operating, the hot gas A expands in the direction of flow. As a result, the pressure of the hot gas A is continuously reduced in the direction of flow. A coolant K which is under a certain pressure in the space 49 will therefore escape from the space 49 toward the lower ambient pressure, i.e. at the downstream, second circumferential-face edge 49B. The sealing system 51 on the first circumferential-face edge 39A and on the second circumferential-face edge 39B seals the space 49 in both directions. Therefore, this design offers a particularly high degree of protection both against the penetration of hot gas A into the space 49 and against the escape of coolant K from the space 49.

On the first circumferential-face edge 39A, the sealing system 51 includes a sealing element 53 which extends in the circumferential direction of the rotor 29. The sealing element 53 engages in a recess 35, in particular in a groove, which is machined into the circumferential face 31. At the second circumferential-face edge 39B, the sealing system 51 includes as a sealing element 53 which extends in the circumferential direction. A further sealing element 55 is provided on the second circumferential-face edge 39B. The further sealing element 55 extends in the circumferential direction of the rotor disk 29 and is arranged at an axial distance from the sealing element 53.

Forming the sealing system 51 by using one or more sealing elements 53, 55 is particularly suitable for more efficient prevention of the possibility of axial leaking flows of coolant K and/or of hot gas A in the space 49. For example, an axial leaking flow directed upstream, e.g. of the hot gas A out of the flow passage of a gas turbine 1, which flows into the space 49 over the first circumferential-face edge 39A along the circumferential face 31, is effectively prevented from penetrating by the sealing element 51 arranged on the first circumferential-face edge 39. At the same time, an axial leaking flow which is directed out of the space 49 along the second circumferential-face edge 39B is reliably prevented from occurring by the obstacle in the form of the sealing elements 53, 55.

This multiple arrangement of sealing elements 53, 55 considerably reduces the possibility of leaking flows in the space 49. Therefore, the sealed space 49 can be used efficiently for a coolant K, e.g. cooling air K. This can be pressurized and can then be used for efficient internal cooling of the rotor 25 which is exposed to high thermal loads, in particular of the blade platform 17 and of the main blade 45 which adjoins the blade platform along the longitudinal axis 47. A further advantageous use of the pressurized coolant K in the space 49 is provided by the blocking action with respect to the hot gas A in the flow passage. This blocking action of the coolant K substantially prevents hot gas A from penetrating into the space 49.

The sealing elements 53, 55 are each arranged so that they can move in the radial direction in the recess 35, so that when the rotor 25 is operating, on account of the centrifugal force acting on the sealing elements 53, 55, an improved sealing action compared to conventional designs is achieved. The sealing elements 53, 55 will move radially outward, parallel to the longitudinal axis 47, under the action of centrifugal force. In the process, the disk-side base 63 of the blade platform 17 is very effectively sealed with respect to possible axial leaking flows out of the space 49 or into the space 49. The radial mobility of the sealing elements 53, 55 can be provided by suitably designing the recess 35 and the sealing elements 53, 55. As a result, the sealing elements 53, 55 can also be removed and, if necessary, exchanged without problems for any maintenance which may be required or in the event of a failure of the rotor blade 13, without having to use additional tools and without the risk of the sealing element 53 becoming jammed as a result of an oxidizing or corrosive attack at high operating temperatures.

Furthermore, a certain tolerance of the sealing elements 53, 55 which in each case engage in a recess 35, in particular in a groove, is very advantageous. This allows thermal expansion and therefore prevents thermally induced stresses. The sealing element 53, 55 preferably includes a first partial sealing element 67A and a second partial sealing element 67B. The first partial sealing element 67A and the second partial sealing element 67B engage in one another. By their paired arrangement, the partial sealing elements 67A, 67B complement one another to form a sealing element 53, 55 in a particular way, the sealing action achieved by the paired partial sealing elements 67A, 67B being greater than that achieved by an individual partial sealing element 67A, 67B. A particularly advantageous configuration of the partial sealing elements 67A, 67B on the regions in the space 49 which are to be sealed in each case ensures that the sealing action achieved by the paired arrangement is greater than that which could be achieved with, for example, a single-piece sealing element 53. A possible, particularly advantageous configuration of the partial sealing elements 67A, 67B is described below with reference to FIGS. 5A to 5D and FIGS. 6A to 6D.

Figure 5A:
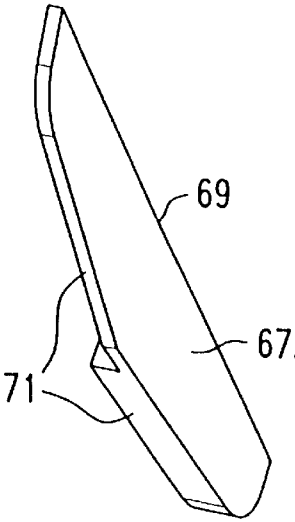
FIGS. 5A–5D show various views of a first partial sealing element of a sealing element illustrated in FIG. 4, FIGS. 6A–6D show various views of a second partial sealing element of a sealing element illustrated in FIG. 4.
Figure 5B:
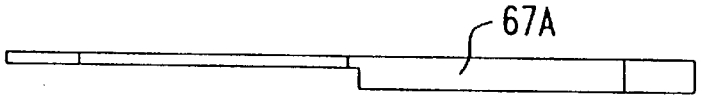
Figure 5C:
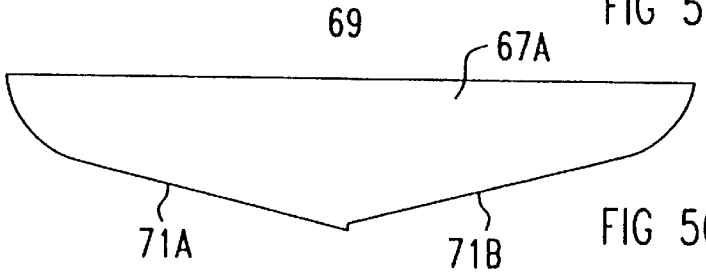
Figure 5D:
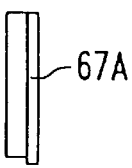
Figure 6A:
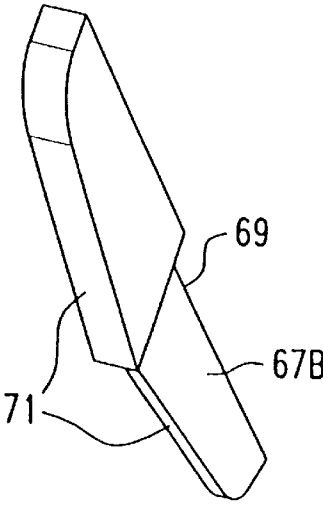
Figure 6B:
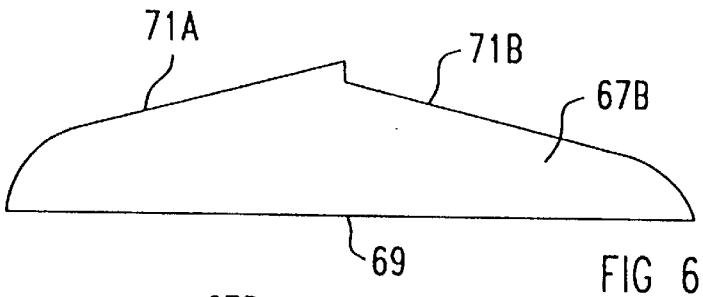
Figure 6C:
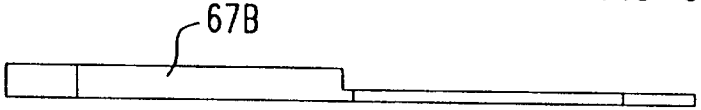
Figure 6D:
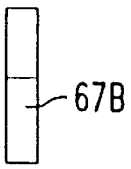

The sealing element 53, 55 shown in FIG. 4, in a preferred configuration, includes two partial sealing elements 67A, 67B which engage in one another. FIGS. 5A to 5D show various views of the first partial sealing element 67A:

FIG. 5A shows a perspective view of the first partial sealing element 67A. The first partial sealing element 67A preferably includes a disk-sealing edge 69 and a platform-sealing edge 71 which lies opposite the disk-sealing edge 69. In the installed state of the partial sealing element 67A, the disk-sealing edge 69 adjoins the circumferential face 31, and the platform-sealing edge 71 adjoins the disk-side base 63 of the blade platform 17. FIG. 5B shows a view of the disk-sealing edge 71 of the first partial sealing element 67A, FIG. 5C shows a plan view of the first partial sealing element 67A, and FIG. 5D shows a side view.

The platform-sealing edge 71 preferably includes a first partial platform-sealing edge 71A and a second partial platform-sealing edge 71B. This dividing of the platform-sealing edge 71 into two partial platform-sealing edges 71A, 71B makes it easy to adapt the design of the first partial sealing element 67A to the particular installation geometry of a rotor blade 13 and of a further rotor blade 13B in a rotor disk 29 (cf. FIG. 3 and FIG. 4).

The second partial sealing element 67B is preferably designed in a corresponding way. FIGS. 6A to 6D show various views of the second partial sealing element 67B of a sealing element 53 illustrated in FIG. 4. In a similar way to the first partial sealing element 67A, the second partial sealing element 67B preferably includes a disk-sealing edge 69 and a platform-sealing edge 71 which lies opposite the disk-sealing edge 69. In this case, the platform-sealing edge 71 is further divided in functional terms into partial platform-sealing edges 71A, 71B. A first partial platform-sealing edge 71A and a second partial platform-sealing edge 71B are preferably provided. Each of the partial sealing elements 67A, 67B is designed in such a way that its center of gravity is arranged adjacent to precisely one of the partial platform-sealing edges 71A, 71B assigned to the corresponding partial sealing element 67A, 67B. This is achieved by using a stepped design of each of the partial sealing elements 67A, 67B, with a region of reduced material thickness and a region of greater material thickness, each region being assigned to precisely one partial platform-sealing edge 71A, 71B.

The result of this special design of the partial sealing elements 67A, 67B is that the disk-sealing edge 69 is well sealed against the circumferential face 31 and the platform-sealing edge 71, or each of the partial platform-sealing edges 71A, 71B, is/are sealed against the blade platform 17 of the rotor blade 13, with a form fit and improved mechanical stability being produced. The first partial sealing element 67A, and the second partial sealing element 67B are preferably arranged in pairs to form a sealing element 53. The result is a very efficient seal. The partial sealing elements 67A, 67B are preferably designed in such a way that, in the installed state, they engage in one another and overlap one another, the platform-sealing edge 71 and the disk-sealing edge 69 of the first partial sealing element 67A being adjacent to the platform-sealing edge 71 and the disk-sealing edge 69, respectively, of the second partial sealing element 67B. The partial sealing elements 67A, 67B are preferably arranged in such a way that regions of different material thickness come into contact with one another.

Therefore, the paired arrangement of the two partial sealing elements 67A, 67B produces a very good form fit, and consequently the sealing element 53 achieves a good seal against the penetration of hot gas A into the space 49 and/or the escape of coolant K into the flow passage (cf. FIG. 4). The partial sealing elements 67A, 67B are in the form of, for example, of metallic sealing plates. The material selected is able to withstand high temperatures and has sufficient elastic deformation properties. Examples of suitable materials are a nickel-base alloy or a cobalt-base alloy. This ensures that the material of the partial sealing elements 67A, 67B is selected to match the material of the rotor 25. As a result, contamination or diffusion damage is avoided and uniform, substantially stress-free thermal expansion of the rotor 25 is possible.

Figure 7:
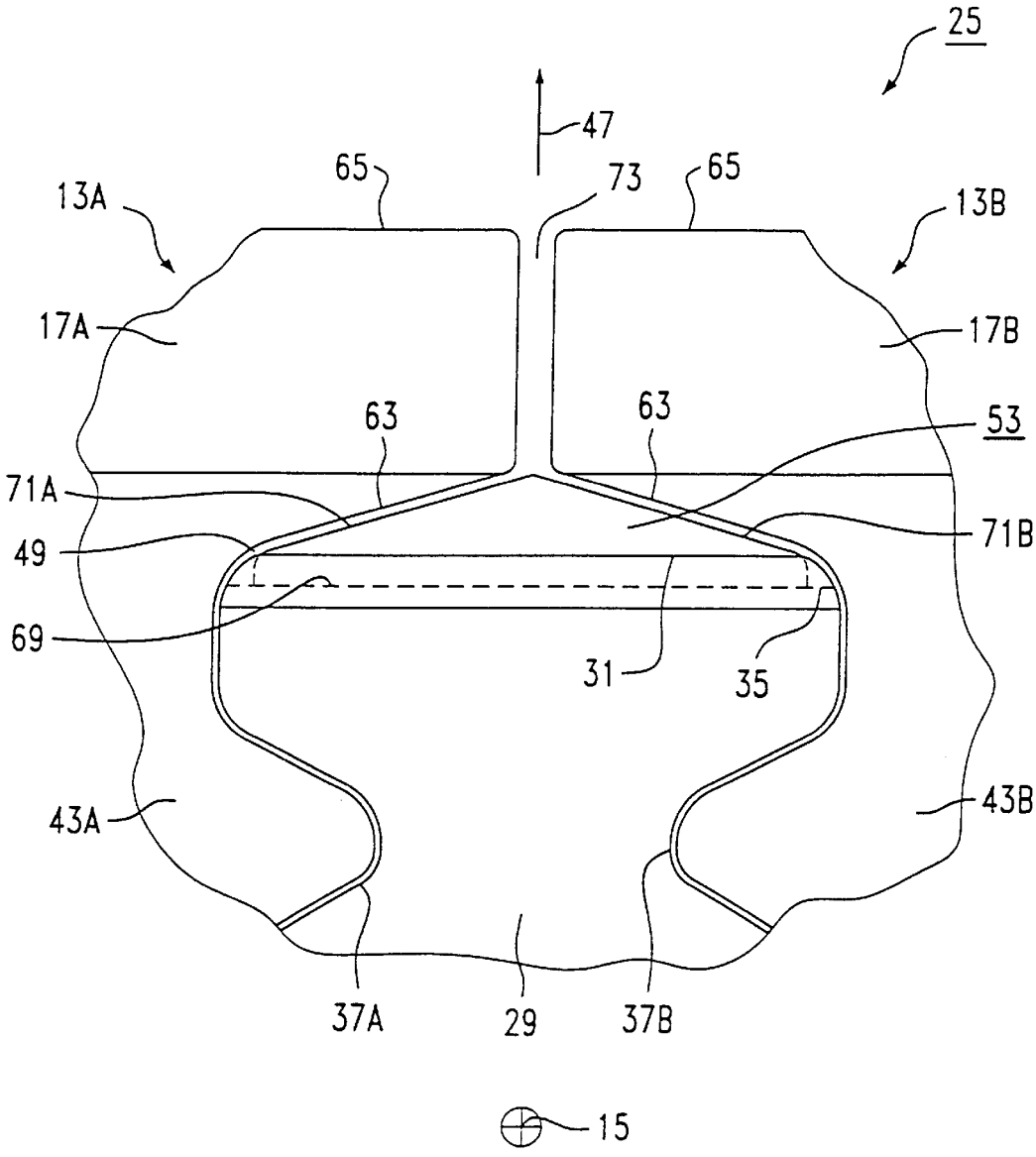
FIG. 7 shows an axial plan view of part of a rotor with sealing element.

FIG. 7 shows an axial plan view of part of a rotor 25 with a sealing element 53. The rotor 25 includes a rotor disk 29. The rotor disk 29 includes a first rotor-disk groove 37A and a second rotor-disk groove 37B, which is arranged at a distance from the first rotor-disk groove 37A in the circumferential direction of the rotor disk 29. A first rotor blade 13A and a second rotor blade 13B are inserted into the rotor disk 29, the blade root 43A of the first rotor blade 13A being inserted into the rotor-disk groove 37A, and the blade root 43B of the second rotor blade 13B engaging in the second rotor-disk groove 37B. The blade platform 17A of the first rotor blade 13A adjoins the blade platform 17B of the second rotor blade 13B, and a space 49 is formed between the blade platforms 17A, 17B and the circumferential face 31.

A sealing element 53 is provided in the space 49 on the circumferential face 31. The sealing element 53 includes a disk-sealing edge 69 and a first partial platform-sealing edge 71A and a second partial platform-sealing edge 71B lying opposite the disk-sealing edge 69. The sealing element 53 is inserted into a recess 35, in particular into a groove in the circumferential face 31. The disk-sealing edge 69 adjoins the circumferential face 31. The first partial platform-sealing edge 71A adjoins the disk-side base 63 of the first blade platform 17A, and the second partial platform-sealing edge 71B adjoins the disk-side base 63 of the second blade platform 17B.

The sealing element 53 may be produced by two paired partial sealing elements 67A, 67B which engage in one another and can move in the radial and circumferential directions, as explained in FIGS. 5A to 5D and in FIGS. 6A to 6D. This allows particularly efficient sealing of the space 49. In particular, axially directed leaking flows out of the space 49 or into the space 49 are effectively prevented.

When the rotor 25 is rotating, the sealing element 53 moves radially outward, away from the axis of rotation 15 of the rotor 25, parallel to the longitudinal axis 47 under the action of centrifugal force. This effect is used to achieve a significantly improved sealing action at the mutually adjoining blade platforms 17A, 17B of the adjacent rotor blades 13A, 13B. The sealing element 53 or each of the paired partial sealing elements 67A, 67B (not shown in FIG. 7, but cf. FIGS. 5A–5D and 6A–6D), under the action of centrifugal force, comes into contact with the blade platforms 17A, 17B which are at a radial distance from the circumferential face 31 and are adjacent to one another in the circumferential direction, and is pressed firmly onto the disk-side base 63 of these platforms.

Suitable dimensioning of the recess 35, in particular of the groove, and of the sealing element 53 ensures sufficient radial mobility. In addition, it is provided for the sealing element 53 to be able to move in the circumferential direction of the rotor disk 29. The sealing element 53, in particular each of the partial sealing elements 67A, 67B (which are not shown in FIG. 7, but cf. FIGS. 5A–5D and FIGS. 6A–6D), will then adjust itself under the action of all the external forces, such as for example the centrifugal force and also the normal and/or bearing forces, in order to provide its sealing action. The inclination of the partial platform-sealing edges 71A, 71B with respect to the longitudinal axis 47 corresponds to the inclination of the disk-side base 63 of the blade platforms 17A, 17B. The result is a good form fit and, on account of the inclination with respect to the longitudinal axis 47, a distribution of forces over the sealing element 53 and the adjoining disk-side base 63, which is advantageous for the sealing action. Installation conditions may lead to a gap 73 forming between the adjacent platforms 17A, 17B. This gap 73 is in flow communication with the space 49 and can if appropriate be sealed by means of a simple gap seal element (cf. FIG. 11 and the description associated with this figure).

Figure 8:
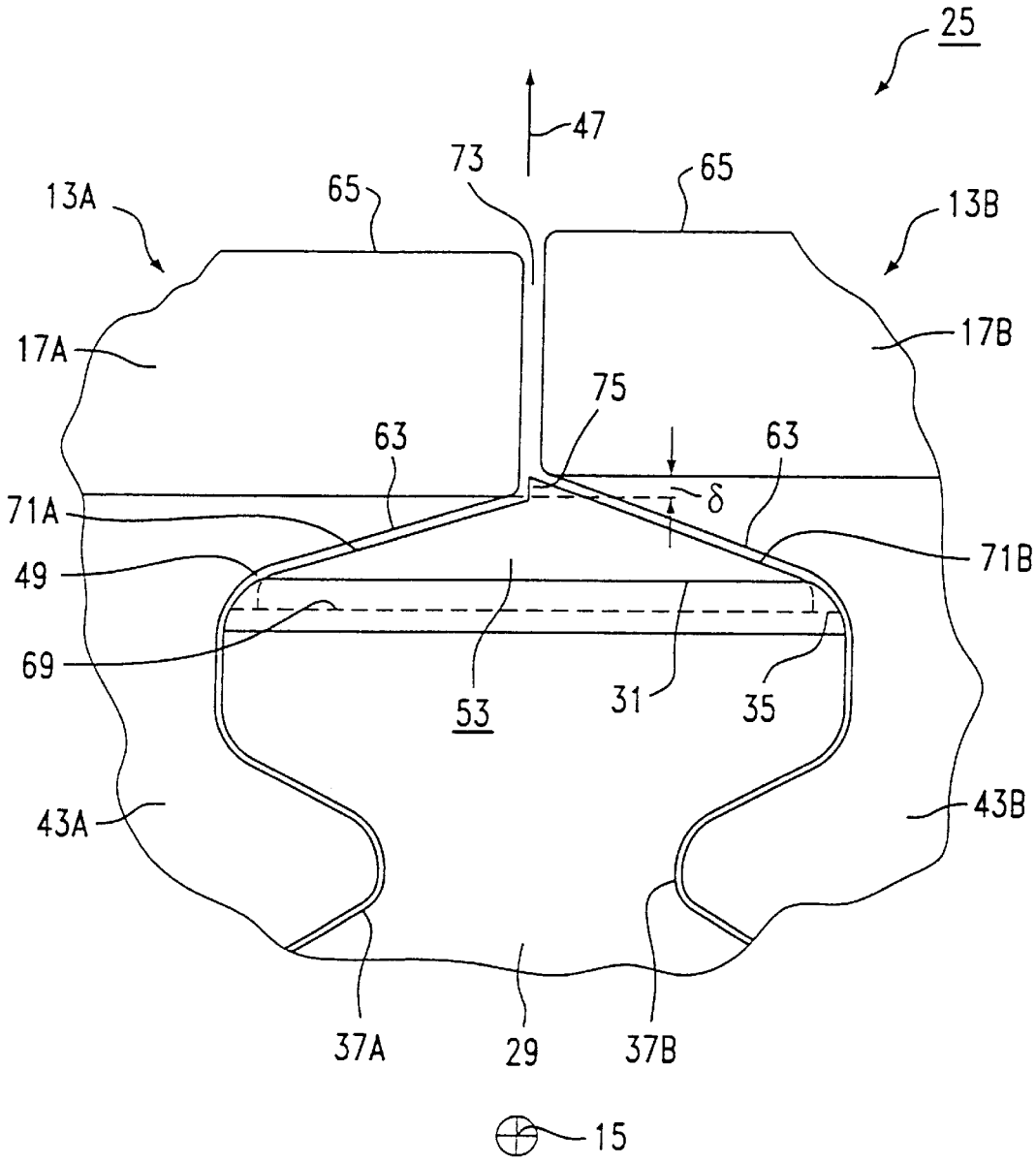
FIG. 8 shows an axial plan view of part of a rotor with an alternative configuration of the sealing element to that shown in FIG. 7.

An axial plan view of part of a rotor 25 with an alternative configuration of the sealing element 53 to that shown in FIG. 7 is illustrated in FIG. 8. The blade platform 17A of the first rotor blade 13A is offset in the radial direction with respect to the adjoining blade platform 17B of the second rotor blade 13B. An offset δ of this type between blade platforms 17A, 17B which adjoin one another in the circumferential direction generally occurs, for installation reasons, when the rotor-disk grooves 37A, 37B are inclined with respect to the axis of rotation 15 of the rotor 25. The sealing element 53, or each of the partial sealing elements 67A, 67B arranged in pairs to form the sealing element 53 (this arrangement is not shown in FIG. 7, but see, for example, FIGS. 5A–5D and FIGS. 6A–6D), is equipped with an offset-sealing edge 75, which seals the offset δ in a positively locking manner. The sealing concept described can therefore be flexibly applied to various rotor geometries and installation dimensions by suitably designing the sealing element 53.

Figure 9:
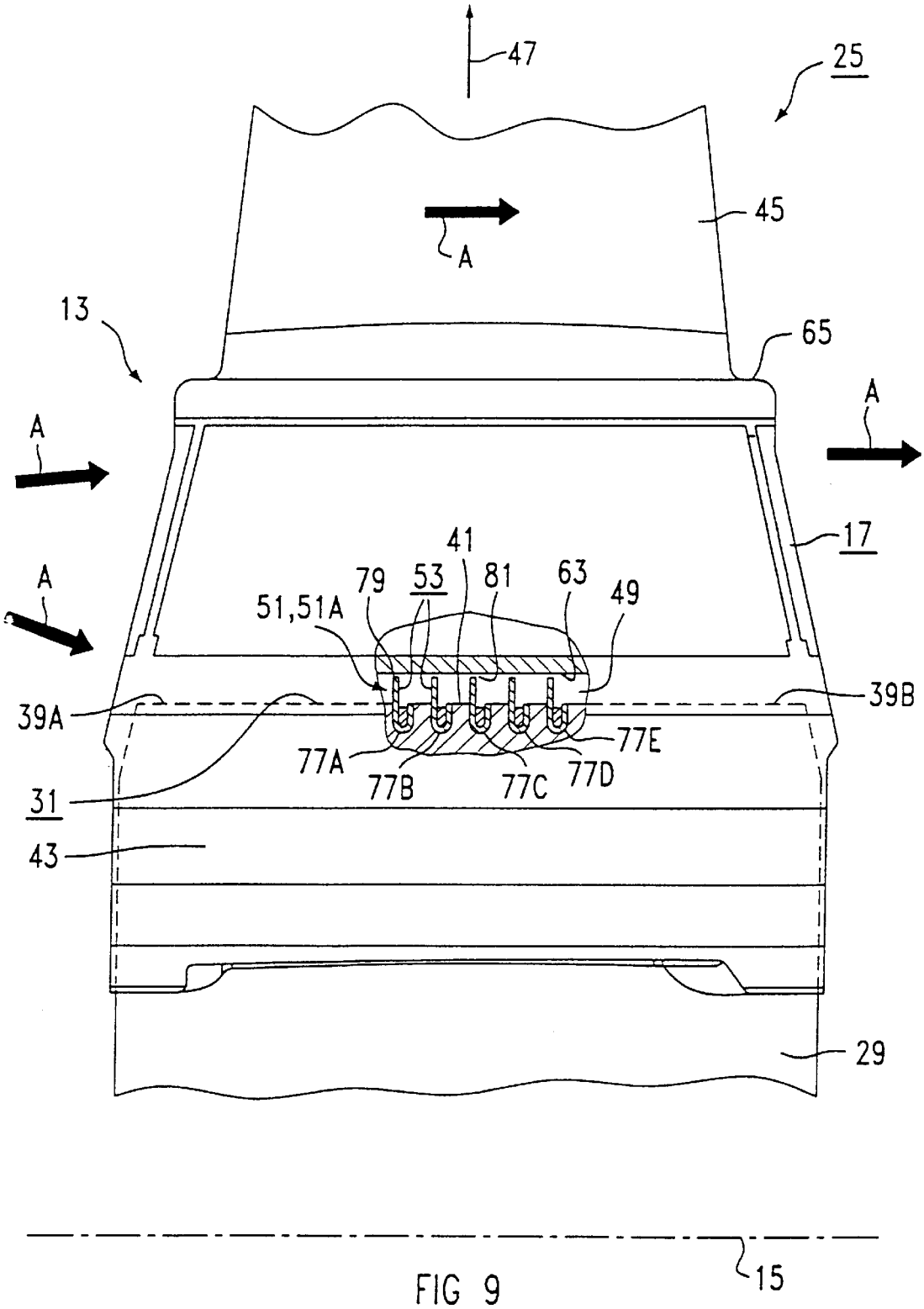
FIG. 9 shows a side view of a rotor blade with a labyrinth sealing system.

FIG. 9 shows a side view of a rotor blade 13 which is inserted in a rotor disk 29, the sealing system 51 being arranged in the space 49 on the circumferential-face central region 41 of the circumferential face 31. The sealing system 51 is in this case designed as a labyrinth sealing system 51A, in particular a labyrinth gap sealing system 51A. The labyrinth gap sealing system 51A is produced by a plurality of sealing elements 53, which extend in the circumferential direction of the rotor disk 29 and are spaced apart from one another in the axial direction, on the circumferential-face central region 41. The individual sealing elements 53 are in this case each formed by a metal restrictor plate 77A–77E jammed into the circumferential face 41. The action of the labyrinth gap sealing system 51A produced by the various metal restrictor plates 77A–77E is based on restricting a flowing hot gas A and/or a coolant K as efficiently as possible in the sealing system 51A and, as a result, substantially reducing an axially directed leaking flow through the space 49.

The outer radial end 79 of a metal restrictor plate 77A is spaced apart from the disk-side base 63 of the blade platform 17 by a sealing gap 81. A residual leaking flow in the space 49 may arise through the seal gap 81, as is generally the case with labyrinth gap seals 51A. By suitably designing and arranging the metal restrictor plates 77A–77E of the labyrinth gap sealing system 51A, the residual leaking flow is limited to a predetermined level. Compared to other possible labyrinth sealing systems, the labyrinth gap sealing system 51A has the advantage that the sealing gaps 81 produce a tolerance with respect to thermally and/or mechanically induced relative expansions in the rotor 25.

Figure 10:
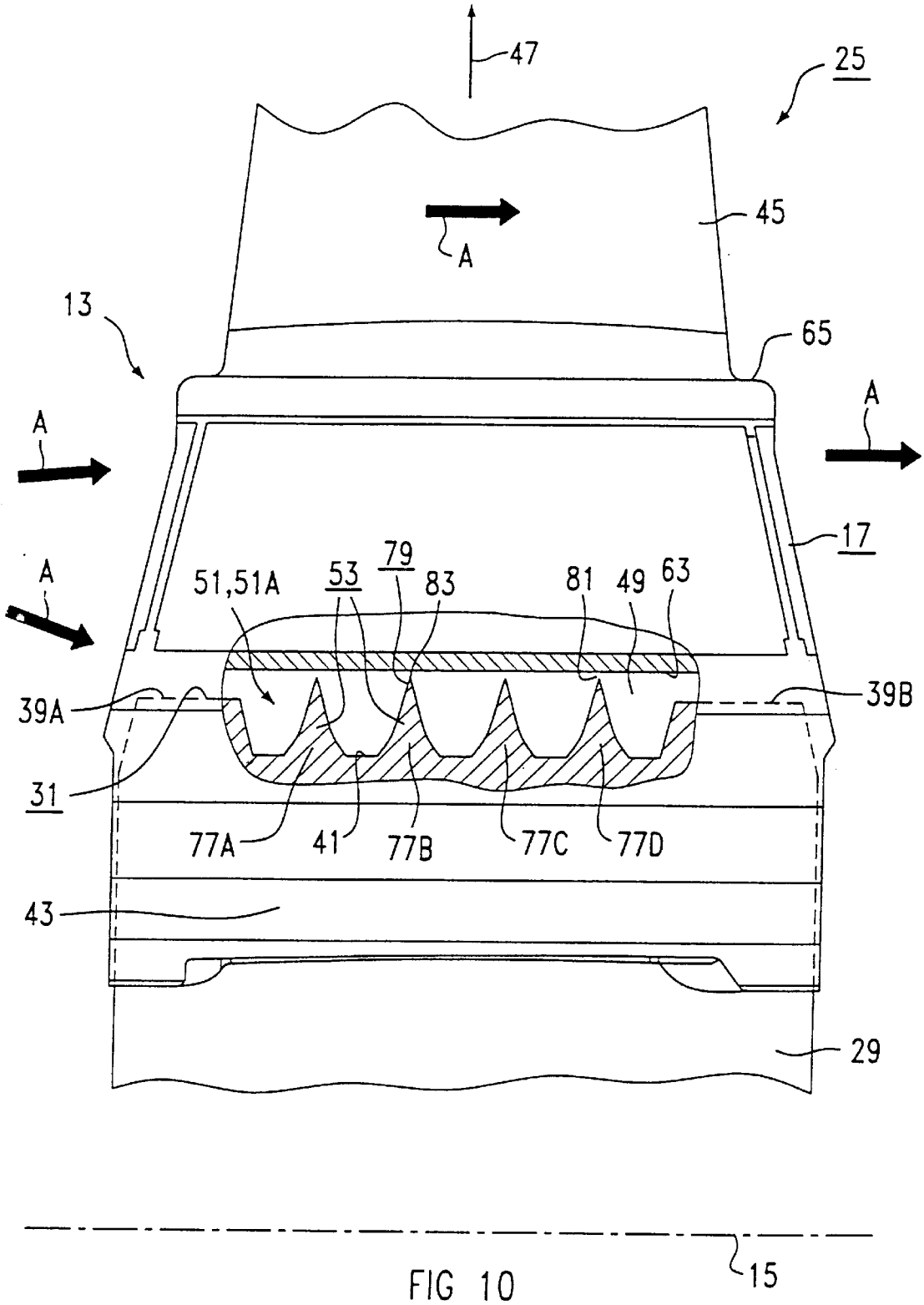
FIG. 10 shows a side view of a rotor blade with an alternative configuration of the labyrinth sealing system of that shown in FIG. 9.

An alternative configuration to the sealing system 51 shown in FIG. 9 is illustrated in FIG. 10. The sealing system 51 is likewise designed as a labyrinth gap sealing system 51A, in this case being produced integrally, in particular by removing material from the rotor disk 29. The labyrinth gap sealing system 51A is arranged on the circumferential-face central region 41 of the rotor disk 29. The labyrinth gap sealing system 51A has a plurality of sealing elements 53 which extend in the circumferential direction of the rotor disk 29 and are at an axial distance from one another. The sealing elements 53 are produced by four metal restrictor plates 77A–77D which are turned out of the solid rotor disk 29. This production method means that there is no need for an additional connection element between the labyrinth gap sealing system 51A and the circumferential face 31. This is also an inexpensive solution in turns of process engineering. Furthermore, thermally induced stresses between the rotor disk 29 and the labyrinth gap sealing system 51A do not play a role, since only one material is used.

Other configurations of the sealing element 53, for example using a metal restrictor plate 77A welded onto the rotor disk, are also possible. At its outer radial end 79, the sealing element 53 has a sealing tip 83, in particular a knife edge. The sealing gap 81 can be reduced to the smallest possible size by sharpening the outer radial end 79 of the sealing element 53. In this way, residual leaking flows through the space 49 are reduced further. It is also possible to bridge the sealing gap, by producing the sealing point 83 or the knife edge with a slight oversize compared to the radial installation dimension of the blade platform 17. By fitting the sealing tip 83 or the knife edge onto the disk-side base 63 of the blade platform 17, the sealing gap 81 is then bridged when the rotor blade is inserted into the rotor disk 29. In this way, the sealing gap 81 is virtually completely closed, a considerably improved sealing action is achieved and a possible axial leaking flow, for example caused by the flowing hot gas A or by a coolant K, in the space 49 is further reduced.

Figure 11:
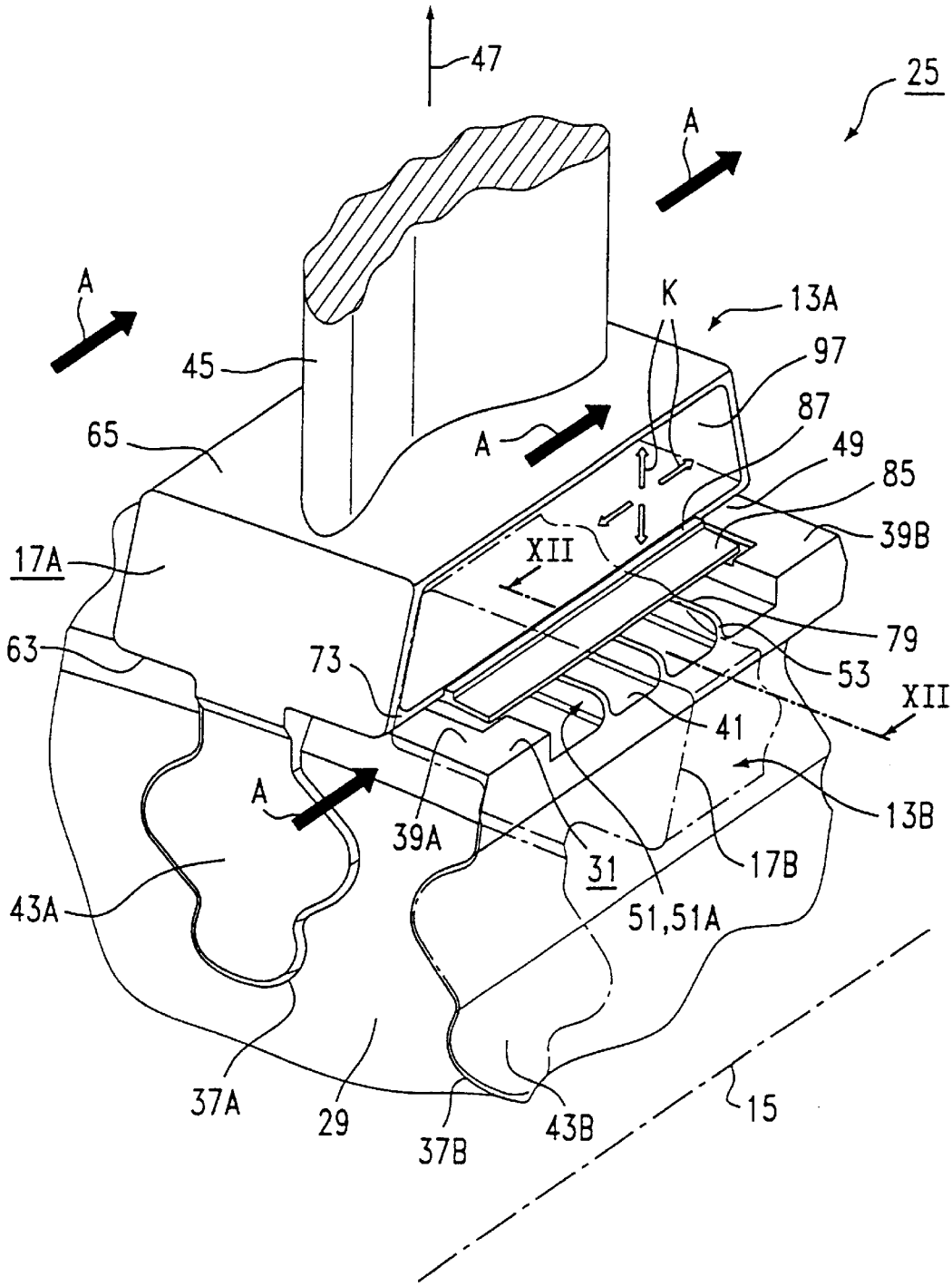
FIG. 11 shows a perspective view of part of a rotor disk with inserted rotor blade and with a gap sealing element.

FIG. 11 shows a perspective view of part of a rotor disk 29 with inserted rotor blades 13A, with the blade root 43A of the rotor blade 13A inserted in a first rotor-disk groove 37A. The blade root 43B of a second rotor blade 13B, which is illustrated in dashed lines, is inserted in a second rotor-disk groove 37B and is arranged adjacent to the rotor blade 13A in the circumferential direction of the rotor disk 29. The sealing system 51, which is designed as a labyrinth gap sealing system 51A, is arranged on the circumferential face 31, on the circumferential-face central region 41. The sealing system 51A is produced by a plurality of sealing elements 53 which are spaced apart from one another along the axis of rotation 15 and extend in the circumferential direction of the rotor disk 29. Between the blade platform 17A of the rotor blade 13A and the blade platform 17B of the second rotor blade 13B there is a substantially axially extending gap 73 which is in flow communication with the space 49.

A gap sealing element 85 is provided for the purpose of sealing the gap 73. The gap sealing element 85 is produced in a simple way by means of a suitable metal gap sealing plate which has a gap-sealing edge 87. The gap-sealing edge engages in the gap 73 under the action of centrifugal force and seals the gap 73. The gap sealing element 85 is arranged in the space 49 in such a way that it radially adjoins the sealing system 51, in particular the labyrinth gap sealing system 51A. The gap sealing element 85 substantially prevents a leaking flow through the gap 73. A leaking flow through the gap 73 of this type is substantially radially directed and may be oriented both radially outward from the space 49 through the gap 73 and radially inward through the gap 73 into the space 49.

A cavity 97 is formed by the platforms 17A, 17B, which adjoin one another in the circumferential direction of the rotor disk 29, of the rotor blades 13A, 13B. This cavity adjoins the gap 73 on the radially outer side (box design of the rotor blades 13A, 13B). In this case, the gap sealing element 85 on the one hand prevents the possible penetration of hot gas A from the space 49 through the gap 73 radially outward into the cavity 97. Secondly, the cavity 97, which is sealed by the gap sealing element 85, can be acted on by a coolant K, e.g. by cooling air K. The coolant K is fed to the cavity 97 under pressure, where it is available for efficient internal cooling of the rotor blades 13A, 13B which are subject to high thermal loads or for other cooling purposes. Furthermore, the barrier action of a pressurized coolant K in the cavity 97 can be used against the hot gas A in the flow passage.

In order to be able to withstand the high temperatures which occur when the rotor 25 is operating and to be as resistant as possible to the oxidizing and corrosive properties of the hot gas A, the gap sealing element 85 is made from a material which is able to withstand high temperatures, in particular from a nickel-base or cobalt-based alloy.

Figure 12:
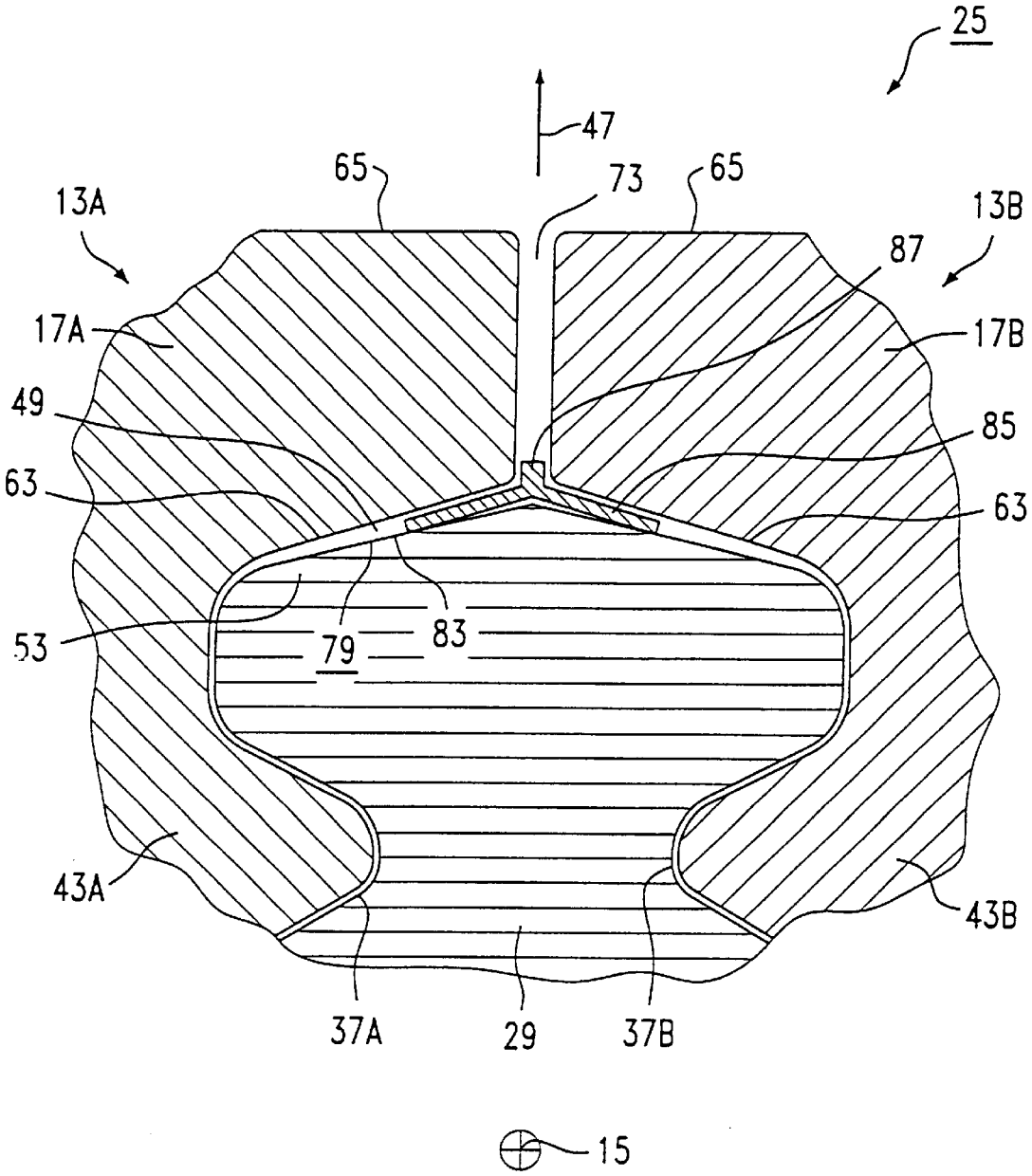
FIG. 12 shows part of a view of the arrangement shown in FIG. 11, on section line XII—XII.

FIG. 12 shows part of a view of the arrangement shown in FIG. 11 on section line XII—XII. The gap sealing element 85 is arranged in the space 49 and adjoins the sealing element 53 in the radially outward direction. When the rotor 25 is operating, the gap sealing element 85, on account of the rotation, is pressed firmly onto the disk-side base 63 of the mutually adjoining platforms 17A, 17B by the centrifugal force which is directed radially outward along the longitudinal axis 47, the gap sealing edge 87 engaging in the gap 73 and, as a result, substantially closing off the gap 73. The combination of the gap sealing element 85 with the sealing system 51 on the circumferential face 41, in particular with the labyrinth sealing system 51A (cf. FIG. 11), produces a particularly effective sealing of the space 49 with respect to possible leaking flows of hot gas A and/or of coolant K. In this combination, the sealing system 51 substantially reduces the axially directed leaking flows, while the gap sealing element 85 substantially reduces the radially directed leaking flows (cf. FIG. 11). In this way, the gap sealing element 85 and the sealing system 51 complement one another very effectively.

In addition to a rotor blade 13 being secured in a substantially axially directed rotor-disk groove 37 in a rotor disk 29, other ways of securing the rotor blade are also known. The use of the sealing system described for alternative means of securing the rotor blade is illustrated below in FIGS. 13 to 15.

Figure 13:
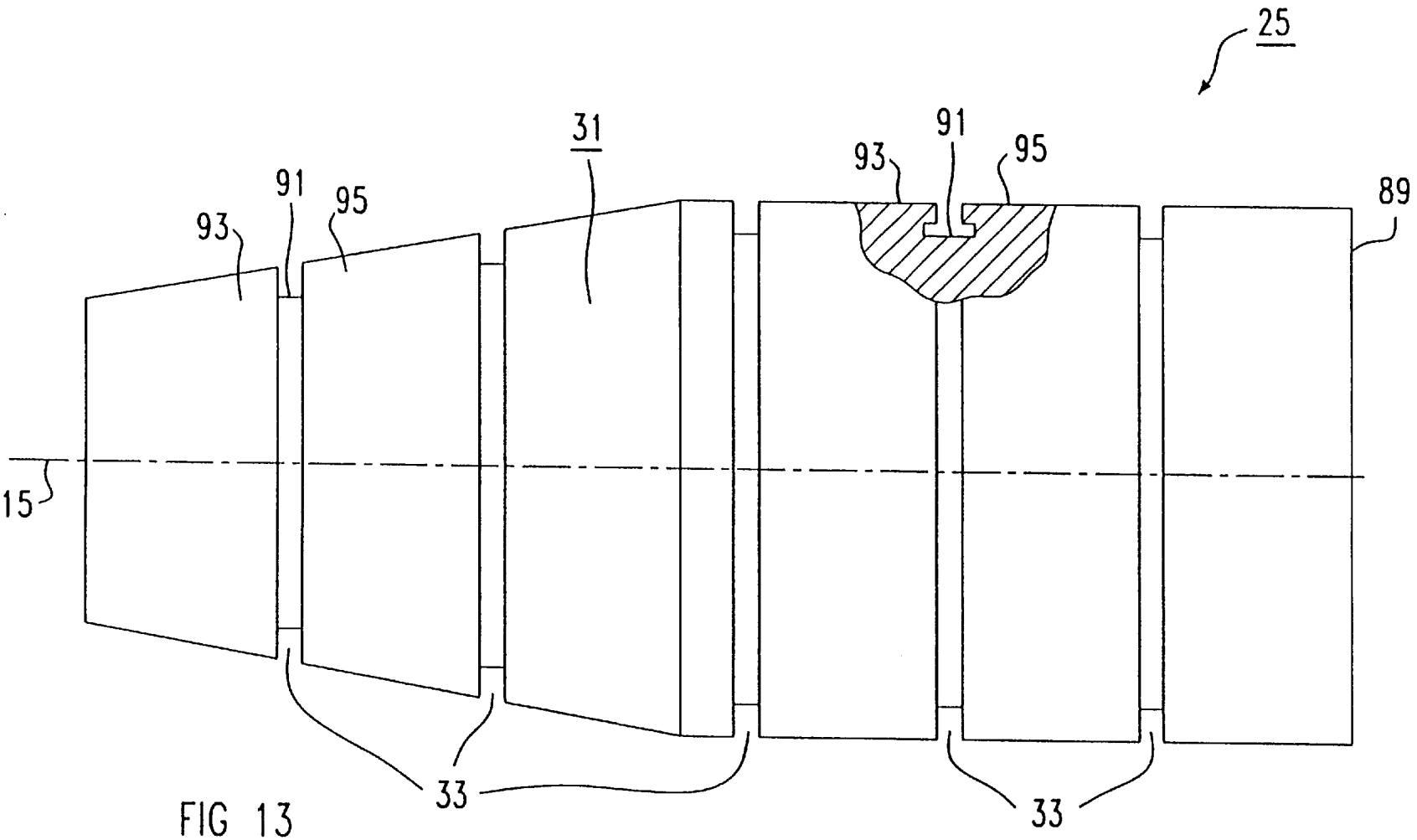
FIG. 13 shows a perspective view of a rotor shaft with circumferential grooves.

FIG. 13 shows a perspective view of a rotor shaft 89 of a rotor 25 which extends along an axis of rotation 15. A receiving structure 33 is produced by a plurality of circumferential grooves 91 which are at an axial distance from one another, extend over the entire circumference of the rotor shaft 89 and are machined into the circumferential face 31. In this case, the circumferential face 31 includes a first circumferential face 93 and a second circumferential face 95, which lies opposite the first circumferential face 93 along the axis of rotation 15. The first circumferential face 93 and the second circumferential face 95 each axially adjoin a circumferential groove 91. The circumferential faces 93, 95 each form an outer radial boundary surface of the rotor shaft 89.

Figure 14:
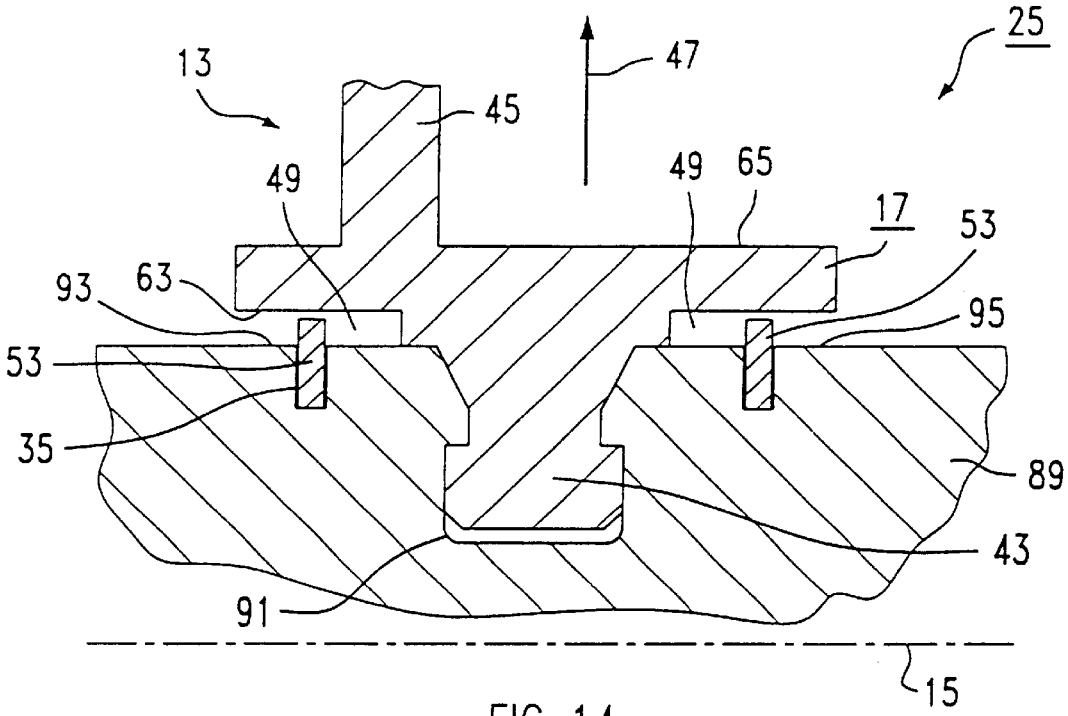
FIG. 14 shows a sectional view of part of a rotor with circumferential groove and with inserted rotor blade.

FIG. 14 shows a sectional view of part of a rotor 25 with circumferential groove 91 and with inserted rotor blade 13. The circumferential groove 91 is produced as a hammerhead groove which receives the blade root 43. This method of securing the blade is preferably used for short rotor blades 13 which are subject to low centrifugal forces and bending moments. A sealing element 53 is provided in the space 49 on both the first circumferential face 93 and the second circumferential face 95. The sealing element 53 extends in the circumferential direction of the rotor shaft 89 and engages in a recess 35, in particular in a groove, in the rotor shaft 89. The sealing element 53 is arranged radially moveably in the recess 35. When the rotor shaft 89 rotates about the axis of rotation 15, the sealing element 53 will move radially outward along the longitudinal axis 47 of the rotor blade 13, under the action of centrifugal force, and will be pressed firmly onto the disk-side base 63 of the blade platform 17. As a result, the space 49 is sealed. The sealing element 53 may be assembled from two paired partial sealing elements 67A, 67B which engage in one another and are not shown in FIG. 14 (see, for example, FIG. 4 and FIGS. 5A–5D and 6A–6D).

Figure 15:
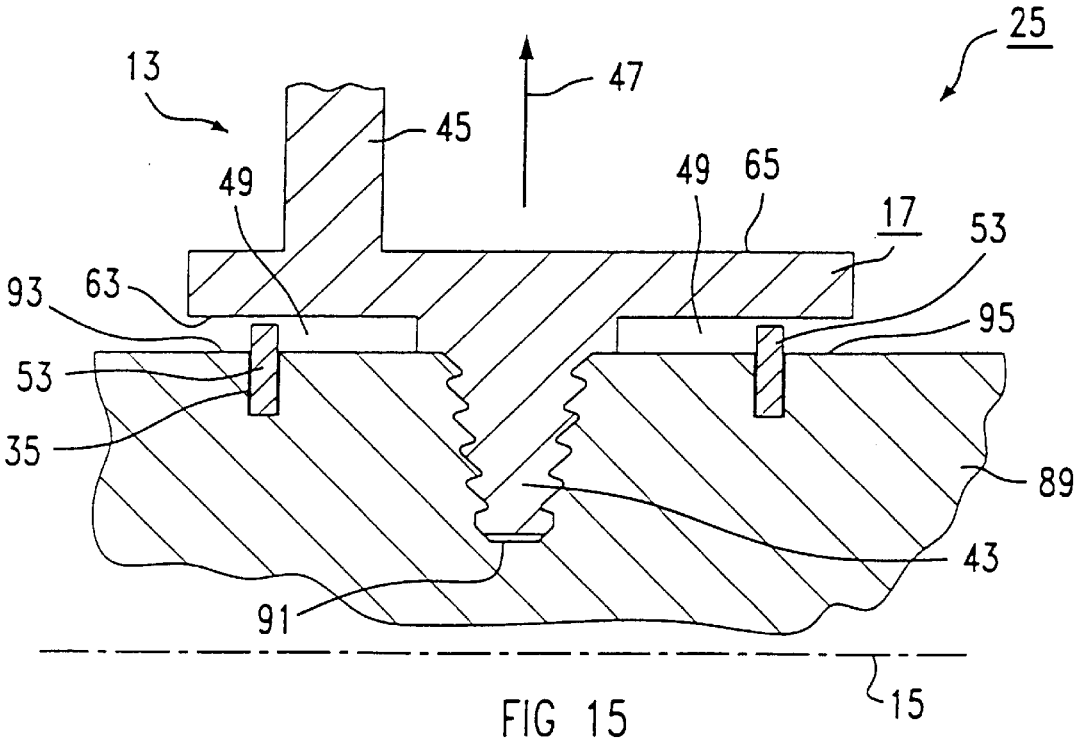
FIG. 15 shows a sectional view of part of a rotor with an alternative configuration of the rotor-blade securing to that shown in FIG. 14.

FIG. 15 shows a sectional view of part of a rotor 25 with an alternative configuration of the securing of the rotor blade to that shown in FIG. 14. In this case, the circumferential groove 91 is produced by a so-called circumferential fir-tree groove. Accordingly, the blade root 43 of the rotor blade 13 is produced as a fir-tree root which engages in the circumferential groove 91, in particular in the circumferential fir-tree groove. This method of securing the rotor blade 13 produces very effective transmission of forces to the rotor shaft 89 and particularly reliable holding when the rotor 25 rotates about the axis of rotation 15. In a similar manner to that shown in FIG. 14, a sealing element 53 for sealing the space 49 is provided both on the first circumferential face 93 and on the second circumferential face 95 in the space 49.

The concept described for sealing the space 49 can in any event be transferred very flexibly to a rotor 25 whose rotor blade 13 is secured in a circumferential groove 91.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A turbomachine including a rotor which extends along an axis of rotation, the rotor comprising:

a circumferential face, defined by the outer radial boundary surface of the rotor, a receiving structure;

a first rotor blade and a second rotor blade, each including a blade root and a blade platform adjoining the blade root, the blade root of the first rotor blade and the blade root of the second rotor blade being inserted into the receiving structure, so that the blade platform of the first rotor blade and the blade platform of the second rotor blade adjoin one another, wherein a space is formed between the blade platforms and the circumferential face; and a sealing system, provided on the circumferential face in the space, the sealing system including a sealing element extending in the circumferential direction and including a first partial sealing element and a second partial sealing element, the first partial sealing element and the second partial sealing element engaging one another, wherein the partial sealing elements are movable in the circumferential direction relative to one another.

2. The turbomachine as claimed in claim 1, wherein the rotor includes a rotor disk, the disk including the circumferential face and the receiving structure, the circumferential face including a first circumferential-face edge and a second circumferential-face edge, opposite the first circumferential-face edge along the axis of rotation, the receiving structure including a first rotor-disk groove and a second rotor-disk groove, which is a distance from the first rotor-disk groove in the circumferential direction of the rotor disk, and wherein the blade root of the first rotor blade is inserted into the first rotor-disk groove and the blade root of the second rotor blade is inserted into the second rotor-disk groove.

3. The turbomachine as claimed in claim 2, wherein the sealing system is arranged on at least one of the first circumferential-face edge and on the second circumferential-face edge.

4. The turbomachine as claimed in claim 3, wherein a circumferential-face central region, bordered in the axial direction by the first circumferential-face edge and the second circumferential-face edge, is formed on the circumferential face, and wherein the sealing system is arranged at least partially on the circumferential-face central region.

5. The turbomachine as claimed in claim 2, wherein a circumferential-face central region, bordered in the axial direction by the first circumferential-face edge and the second circumferential-face edge, is formed on the circumferential face, and wherein the sealing system is arranged at least partially on the circumferential-face central region.

6. The turbomachine as claimed in claim 1, wherein the rotor includes at least one further sealing element, which extends in the circumferential direction and which is arranged at an axial distance from the sealing element.

7. The turbomachine as claimed in claim 6, wherein at least one of the sealing element and the further sealing element engages in a recess, in the circumferential face.

8. The turbomachine as claimed in claim 7, wherein the recess is a groove.

9. The turbomachine as claimed in claim 7, wherein at least one of the sealing element and the further sealing element is movable in the radial direction.

10. A turbomachine as claimed in claim 7, wherein the sealing element includes a first partial sealing element and a second partial sealing element, the first partial sealing element and the second partial sealing element engaging in one another.

11. The turbomachine as claimed in claim 6, wherein at least one of the sealing element and the further sealing element is movable in the radial direction.

12. A turbomachine as claimed in claim 11, wherein the sealing element includes a first partial sealing element and a second partial sealing element, the first partial sealing element and the second partial sealing element engaging in one another.

13. The turbomachine as claimed in claim 6, wherein the sealing element includes a first partial sealing element and a second partial sealing element, the first partial sealing element and the second partial sealing element engaging in one another.

14. The turbomachine as claimed in claim 13, wherein the first partial sealing element and the second partial sealing element are movable in the circumferential direction relative to one another.

15. The turbomachine as claimed in claim 14, wherein the first partial sealing element and the second partial sealing element each include a disk-sealing edge, which adjoins the circumferential face, and a platform-sealing edge, which adjoins the blade platform.

16. The turbomachine as claimed in claim 13, wherein the first partial sealing element and the second partial sealing element each include a disk-sealing edge, which adjoins the circumferential face, and a platform-sealing edge, which adjoins the blade platform.

17. The turbomachine as claimed in claim 13, wherein the first partial sealing element and the second partial sealing element overlap one another, the platform-sealing edge and the disk-sealing edge of the first partial sealing element being adjacent to the platform-sealing edge and disk-sealing edge, respectively, of the second partial sealing element.

18. The turbomachine as claimed in claim 6 wherein the sealing element is produced from a highly heat-resistant material.

19. The turbomachine of claim 18, wherein the sealing element is produced from at least one of a nickel-base and cobalt-base alloy.

20. The turbomachine as claimed in claim 1, wherein the turbomachine is a gas turbine.

21. The turbomachine as claimed in claim 1, wherein the receiving structure includes a circumferential groove, wherein the circumferential face includes a first circumferential face and a second circumferential face which lies opposite the first circumferential face along the axis of rotation, wherein the first and second circumferential faces each axially adjoin the circumferential groove, and wherein the sealing system is provided on at least one of the first and on the second circumferential face in the space.

22. A rotor, comprising:

a circumferential face, defined by the outer radial boundary surface of the rotor, a receiving structure;

a first rotor blade and a second rotor blade, each including a blade root and a blade platform adjoining the blade root, the blade root of the first rotor blade and the blade root of the second rotor blade being inserted into the receiving structure, so that the blade platform of the first rotor blade and the blade platform of the second rotor blade adjoin one another, wherein a space is formed between the blade platforms and the circumferential face; and a sealing system, provided on the circumferential face in the space, the sealing system including a sealing element extending in the circumferential direction and including a first partial sealing element and a second partial sealing element, the first partial sealing element and the second partial sealing element engaging one another, wherein the partial sealing elements are movable in the circumferential direction relative to one another.

23. A rotor as claimed in claim 22, wherein the rotor includes a rotor disk, the disk including the circumferential face and the receiving structure, the circumferential face including a first circumferential-face edge and a second circumferential-face edge, opposite the first circumferential-face edge along the axis of rotation, the receiving structure including a first rotor-disk groove and a second rotor-disk groove, which is a distance from the first rotor-disk groove in the circumferential direction of the rotor disk, and wherein the blade root of the first rotor blade is inserted into the first rotor-disk groove and the blade root of the second rotor blade is inserted into the second rotor-disk groove.

24. A rotor as claimed in claim 23, wherein the sealing system is arranged on at least one of the first circumferential-face edge and on the second circumferential-face edge.

25. A rotor as claimed in claim 22, wherein the rotor includes at least one further sealing element, which extends in the circumferential direction and which is arranged at an axial distance from the sealing element.

26. A rotor as claimed in claim 25, wherein at least one of the sealing element and the further sealing element engages in a recess, in the circumferential face.

27. A rotor as claimed in claim 25, wherein at least one of the sealing element and the further sealing element is movable in the radial direction.

* * * * *